US012570386B2

(12) United States Patent
Montague et al.

(10) Patent No.: US 12,570,386 B2
(45) **Date of Patent: *Mar. 10, 2026**

(54) WATERCRAFT DEVICE WITH A HANDHELD CONTROLLER

(71) Applicant: Kai Concepts, LLC, Alameda, CA (US)

(72) Inventors: Donald Lewis Montague, Paia, HI (US); Merten Stroetzel, Pacific Palisades, CA (US); Tomasz Bartczak, Toronto (CA); Alec Korver, Monument, CO (US); Joseph Andrew Brock, Alameda, CA (US); Matthew Campbell Greaves, Oxley (AU)

(73) Assignee: Kai Concepts, LLC, Alameda, CA (US)

( * ) Notice: Subject to any disclaimer, the term of this patent is extended or adjusted under 35 U.S.C. 154(b) by 35 days.

This patent is subject to a terminal disclaimer.

(21) Appl. No.: 18/437,307

(22) Filed: Feb. 9, 2024

(65) Prior Publication Data

US 2024/0270366 A1 Aug. 15, 2024

Related U.S. Application Data

(60) Provisional application No. 63/445,404, filed on Feb. 14, 2023.

(51) Int. Cl.

| | |
|---|---|
| ***B63H 21/21*** | (2006.01) |
| ***B63B 32/10*** | (2020.01) |
| ***B63B 79/40*** | (2020.01) |

(52) U.S. Cl.

CPC ..... *B63H 21/213* (2013.01); *B63B 32/10* (2020.02); *B63B 79/40* (2020.01); *B63H 2021/216* (2013.01)

(58) Field of Classification Search

CPC ..... B63H 21/21; B63H 21/213; B63H 2021/216; B63B 32/10; B63B 34/10; B63B 79/40

(Continued)

(56) References Cited

U.S. PATENT DOCUMENTS

| | | | |
|---|---|---|---|
| 1,067,392 | A | 7/1913 | Barr |
| 3,405,677 | A | 10/1968 | Smith |

(Continued)

FOREIGN PATENT DOCUMENTS

| | | | |
|---|---|---|---|
| AU | 5012101 | A | 12/2002 |
| AU | 200150121 | A1 | 12/2002 |

(Continued)

OTHER PUBLICATIONS

7M Engineering, "Assembly 1," https://vimeo.com/361237245, Sep. 20, 2019.

(Continued)

*Primary Examiner* — Atul Trivedi

(74) *Attorney, Agent, or Firm* — Fitch, Even, Tabin & Flannery LLP

(57) ABSTRACT

In one aspect, a wireless remote controller for a personal watercraft is provided that includes a watertight housing forming a watertight compartment. The housing includes a through hole extending through the housing from an upper side of the housing to a lower side of the housing. The remote controller includes a throttle interface removably attached to the housing such that the throttle interface is movable between a first position and a second position and at least a portion of the throttle interface positioned within the through hole of the housing. The remote controller further includes a sensor positioned within the watertight compartment of the housing to detect a position of the throttle interface.

26 Claims, 27 Drawing Sheets

(58) Field of Classification Search
USPC ..... 701/2
See application file for complete search history.

(56) References Cited

U.S. PATENT DOCUMENTS 3,498,131 A 3/1970 Rickey
3,515,000 A 6/1970 Baumoel
3,584,643 A 6/1971 Burke
3,593,050 A 7/1971 Ware
3,704,442 A 11/1972 Wright
3,804,048 A 4/1974 Cline
3,886,884 A 6/1975 Stark
3,902,444 A 9/1975 Stark
4,056,074 A 11/1977 Sachs
4,145,927 A 3/1979 Larson
4,178,871 A 12/1979 Hirsch
4,382,382 A 5/1983 Wang
4,517,912 A 5/1985 Jones
4,676,101 A 6/1987 Baughman
5,042,299 A 8/1991 Wells
5,049,878 A 9/1991 Stern
5,062,378 A 11/1991 Bateman
5,178,089 A 1/1993 Hodel
5,226,313 A 7/1993 Murata
5,309,859 A 5/1994 Miller
5,429,562 A 7/1995 Milner
5,544,607 A 8/1996 Rorabaugh
5,573,088 A 11/1996 Daniels
5,719,556 A 2/1998 Albin
5,726,578 A 3/1998 Hook
5,735,167 A 4/1998 Puukangas
5,749,018 A 5/1998 Wess
5,809,926 A 9/1998 Kelsey
5,848,922 A 12/1998 Itima
6,095,076 A 8/2000 Nesbitt
6,142,840 A 11/2000 Efthymiou
6,178,905 B1 1/2001 Dynes
6,183,333 B1 2/2001 Hall
6,192,817 B1 2/2001 Dec
6,302,230 B1 10/2001 Kamen
6,311,631 B1 11/2001 Beecher
6,355,374 B1 3/2002 Wirsching
6,371,726 B1 4/2002 Jonsson
6,409,560 B1 6/2002 Austin
6,475,045 B2 11/2002 Schultz
6,568,340 B2 5/2003 Dec
6,578,506 B2 6/2003 Bieker
6,591,776 B2 7/2003 Miyazaki
6,651,763 B1 11/2003 Kamen
6,702,634 B2 3/2004 Jung
6,743,064 B2 6/2004 Gieseke
6,855,016 B1 2/2005 Jansen
6,901,872 B1 6/2005 Battle
6,902,446 B1 6/2005 Healey
6,962,079 B2 11/2005 Eguchi
6,966,808 B1 11/2005 Liao
7,047,901 B2 5/2006 Chen
7,089,875 B2 8/2006 Kurze
7,097,523 B2 8/2006 Woolley
7,138,774 B2 11/2006 Negoro
7,143,710 B2 12/2006 Lang
7,166,005 B2 1/2007 Tirloni
7,182,036 B2 2/2007 Levine
7,182,037 B2 2/2007 Otobe
7,226,329 B2 6/2007 Railey
7,243,607 B2 7/2007 Chesney
7,275,493 B1 10/2007 Brass
7,275,607 B2 10/2007 Kamen
7,298,056 B2 11/2007 Gizara
7,506,600 B2 3/2009 Furuya
7,601,041 B2 10/2009 McCarthy
7,731,555 B2 6/2010 Railey
7,980,191 B2 7/2011 Murphy
7,993,178 B2 8/2011 Railey
8,043,135 B1 10/2011 Corn
8,070,544 B2 12/2011 Roman
8,123,578 B2 2/2012 Mewis
8,166,905 B2 5/2012 Gratsch
8,262,425 B1 9/2012 Jones
8,290,636 B2 10/2012 Manning
8,312,831 B2 11/2012 Templeman
8,398,446 B2 3/2013 Railey
8,456,310 B2 6/2013 Becker
8,616,313 B2 12/2013 Simeray
8,636,552 B2 1/2014 Braden
8,702,458 B2 4/2014 Preston
8,807,250 B2 8/2014 Chen
8,851,947 B2 10/2014 Vlock
8,863,681 B2 10/2014 Howes
8,870,614 B2 10/2014 Railey
8,888,544 B1 * 11/2014 Guglielmo ..... B63H 21/213 440/84
8,951,079 B2 2/2015 Railey
9,051,038 B1 6/2015 Herber
9,056,654 B1 6/2015 Fraser
9,101,817 B2 8/2015 Doerksen
9,120,547 B2 9/2015 Vlock
9,162,741 B2 10/2015 Köhnsen
9,359,044 B2 6/2016 Langelaan
9,475,559 B2 10/2016 Czarnowski
9,573,656 B2 2/2017 Templeman
9,586,659 B2 3/2017 Langelaan
9,618,528 B2 4/2017 Lešikar
9,643,694 B2 5/2017 Geislinger
9,645,138 B2 5/2017 Hamm
9,669,902 B2 6/2017 Geislinger
9,701,372 B2 7/2017 Railey
9,718,521 B2 8/2017 Derrah
9,718,528 B2 8/2017 Railey
9,758,962 B2 9/2017 Geislinger
9,789,935 B1 10/2017 Aguera
9,789,943 B2 10/2017 Lehmann
9,835,224 B2 12/2017 Geislinger
9,845,138 B2 12/2017 Köhnsen
9,891,620 B2 2/2018 Green
9,919,784 B1 3/2018 Fisher
9,994,296 B1 * 6/2018 Balogh ..... B63B 79/10
10,029,775 B2 7/2018 Nikmanesh
10,054,443 B1 8/2018 Patel
10,057,676 B2 * 8/2018 Manning ..... H04Q 9/00
10,082,788 B1 9/2018 Dengel
10,099,754 B2 10/2018 Tian
10,110,046 B1 10/2018 Esquibel
D843,303 S 3/2019 Leason
10,227,120 B2 3/2019 Ajello
10,235,870 B2 3/2019 Leason
10,266,239 B2 4/2019 Fry
10,279,873 B2 5/2019 Logosz
D852,112 S 6/2019 Leason
10,308,336 B1 6/2019 Vermeulen
D853,310 S 7/2019 Leason
10,358,194 B1 7/2019 Wengreen
D857,606 S 8/2019 Dane
10,456,658 B1 10/2019 Doerksen
D866,872 S 11/2019 Liu
10,486,771 B2 11/2019 Tian
10,526,057 B2 1/2020 Kohnsen
10,532,797 B2 1/2020 Derrah
10,597,118 B2 3/2020 Montague
10,597,123 B2 3/2020 Bell
D882,010 S 4/2020 Vermillion
10,611,261 B2 4/2020 Pang
10,618,621 B1 4/2020 Rott
10,625,834 B2 4/2020 Macfarlane
D883,177 S 5/2020 Leason
10,647,387 B2 5/2020 Dombois
10,647,392 B2 5/2020 Trewern
10,668,987 B1 6/2020 Murphy
10,668,994 B2 6/2020 Frank
10,683,075 B2 6/2020 Schibli
10,759,503 B2 9/2020 Aguera
10,780,928 B2 9/2020 Pang
10,864,962 B2 * 12/2020 Pankratz ..... B62J 45/422
10,988,032 B2 4/2021 Pang

(56) References Cited

U.S. PATENT DOCUMENTS

| | | | | |
|---|---|---|---|---|
| 11,273,364 | B1 | 3/2022 | Doerksen | |
| 11,334,079 | B2 * | 5/2022 | Afman | G05D 1/0094 |
| 11,703,866 | B2 | 7/2023 | Snyder | |
| 2001/0042498 | A1 | 11/2001 | Burnham | |
| 2002/0072285 | A1 | 6/2002 | Jung | |
| 2002/0088387 | A1 | 7/2002 | Motsenbocker | |
| 2002/0090866 | A1 | 7/2002 | Hoshina | |
| 2003/0019316 | A1 | 1/2003 | Tews | |
| 2003/0033968 | A1 | 2/2003 | Thomson | |
| 2003/0089293 | A1 | 5/2003 | Vos | |
| 2003/0167991 | A1 | 9/2003 | Namanny | |
| 2004/0139905 | A1 | 7/2004 | Chen | |
| 2005/0266746 | A1 | 12/2005 | Murphy | |
| 2006/0249513 | A1 | 11/2006 | Duke | |
| 2007/0180904 | A1 | 8/2007 | Gao | |
| 2008/0041294 | A1 | 2/2008 | Diorio | |
| 2008/0168937 | A1 | 7/2008 | Ruan | |
| 2008/0243321 | A1 | 10/2008 | Walser | |
| 2008/0268730 | A1 | 10/2008 | Heesterman | |
| 2009/0023478 | A1 | 1/2009 | Lowles | |
| 2010/0154534 | A1 | 6/2010 | Hampton | |
| 2011/0014829 | A1 | 1/2011 | Burke | |
| 2011/0056423 | A1 | 3/2011 | Railey | |
| 2011/0201238 | A1 | 8/2011 | Rott | |
| 2011/0256518 | A1 | 10/2011 | Rott | |
| 2012/0000409 | A1 | 1/2012 | Railey | |
| 2012/0126972 | A1 | 5/2012 | Rott | |
| 2013/0029547 | A1 | 1/2013 | Suzuki | |
| 2013/0157526 | A1 | 6/2013 | Martin | |
| 2013/0255560 | A1 * | 10/2013 | Kinoshita | B63B 17/00 114/343 |
| 2013/0293179 | A1 | 11/2013 | Lee | |
| 2014/0053764 | A1 | 2/2014 | Ruan | |
| 2014/0141891 | A1 | 5/2014 | Georgy | |
| 2014/0232379 | A1 | 8/2014 | Nazarian | |
| 2015/0064995 | A1 | 3/2015 | Woods | |
| 2015/0104985 | A1 | 4/2015 | Langelaan | |
| 2015/0118923 | A1 | 4/2015 | Köhnsen | |
| 2016/0077543 | A1 | 3/2016 | Conro | |
| 2016/0185430 | A1 | 6/2016 | Langelaan | |
| 2016/0207601 | A1 | 7/2016 | Köhnsen | |
| 2017/0043844 | A1 | 2/2017 | Chapman | |
| 2017/0045887 | A1 | 2/2017 | Mazin | |
| 2017/0215033 | A1 | 7/2017 | Piraino | |
| 2017/0322585 | A1 | 11/2017 | Tomita | |
| 2017/0368413 | A1 | 12/2017 | Shavit | |
| 2018/0043975 | A1 | 2/2018 | Tan | |
| 2018/0072383 | A1 | 3/2018 | Montague | |
| 2018/0099730 | A1 | 4/2018 | Riegerbauer | |
| 2018/0118311 | A1 | 5/2018 | Köhnsen | |
| 2018/0128882 | A1 | 5/2018 | Yoshiya | |
| 2018/0170493 | A1 | 6/2018 | Terada | |
| 2018/0181161 | A1 | 6/2018 | Long | |
| 2018/0210485 | A1 | 7/2018 | Liang | |
| 2018/0293881 | A1 * | 10/2018 | Leason | G08C 17/02 |
| 2018/0335780 | A1 | 11/2018 | Stevens | |
| 2018/0361870 | A1 | 12/2018 | Zhao | |
| 2018/0370600 | A1 | 12/2018 | Geislinger | |
| 2019/0041891 | A1 | 2/2019 | Parazynski | |
| 2019/0061557 | A1 | 2/2019 | Quick | |
| 2019/0061880 | A1 | 2/2019 | Bousquet | |
| 2019/0106190 | A1 | 4/2019 | Schibli | |
| 2019/0137993 | A1 | 5/2019 | Bertrand | |
| 2019/0161148 | A1 | 5/2019 | Trewern | |
| 2019/0168850 | A1 | 6/2019 | Tian | |
| 2019/0168851 | A1 | 6/2019 | Tian | |
| 2019/0173138 | A1 | 6/2019 | Tian | |
| 2019/0233063 | A1 | 8/2019 | Geislinger | |
| 2019/0233076 | A1 | 8/2019 | Aldama | |
| 2019/0263484 | A1 * | 8/2019 | Wilson | B63B 45/04 |
| 2019/0344662 | A1 | 11/2019 | Warren | |
| 2019/0344862 | A1 | 11/2019 | Tian | |
| 2019/0344874 | A1 | 11/2019 | Liang | |
| 2019/0389551 | A1 | 12/2019 | Aoki | |
| 2020/0018969 | A1 | 1/2020 | Ou | |
| 2020/0047849 | A1 | 2/2020 | Claughton | |
| 2020/0079479 | A1 | 3/2020 | Derrah | |
| 2020/0102052 | A1 | 4/2020 | Geislinger | |
| 2020/0140042 | A1 | 5/2020 | Kohnsen | |
| 2020/0148063 | A1 | 5/2020 | Dastoor | |
| 2020/0172206 | A1 | 6/2020 | Terada | |
| 2020/0172207 | A1 | 6/2020 | Wengreen | |
| 2020/0172213 | A1 | 6/2020 | Rodriguez Rondon | |
| 2020/0197826 | A1 | 6/2020 | Zhang | |
| 2020/0231264 | A1 | 7/2020 | Imai | |
| 2020/0283102 | A1 | 9/2020 | Lind | |
| 2020/0331562 | A1 | 10/2020 | Dombois | |
| 2020/0391831 | A1 | 12/2020 | Jensen | |
| 2021/0024194 | A1 * | 1/2021 | Fox | B63H 20/10 |
| 2021/0107601 | A1 | 4/2021 | Trewern | |
| 2021/0272446 | A1 | 9/2021 | Cortland | |
| 2021/0323637 | A1 | 10/2021 | Leason | |
| 2021/0336461 | A1 | 10/2021 | Luthman | |
| 2021/0347442 | A1 * | 11/2021 | Montague | B63B 1/28 |
| 2021/0394867 | A1 * | 12/2021 | Montague | B63H 21/213 |
| 2022/0063786 | A1 * | 3/2022 | Montague | B63H 21/17 |
| 2022/0179442 | A1 * | 6/2022 | Oshiro | G05G 5/03 |
| 2022/0179443 | A1 * | 6/2022 | Oshiro | G05G 9/02 |
| 2022/0274674 | A1 | 9/2022 | Peter | |
| 2023/0043812 | A1 | 2/2023 | Yanai | |
| 2023/0249788 | A1 | 8/2023 | Inoue | |
| 2024/0059375 | A1 | 2/2024 | Werner | |
| 2024/0181825 | A1 | 6/2024 | Rocha | |
| 2024/0270366 | A1 * | 8/2024 | Montague | B63B 34/10 |
| 2024/0326964 | A1 * | 10/2024 | Inoue | B63B 79/40 |
| 2024/0326971 | A1 * | 10/2024 | Inoue | B63H 20/10 |
| 2024/0326973 | A1 * | 10/2024 | Inoue | B63B 79/10 |
| 2025/0214694 | A1 * | 7/2025 | Montague | B63B 32/10 |

FOREIGN PATENT DOCUMENTS

| | | | |
|---|---|---|---|
| AU | 2004100571 | A4 | 8/2004 |
| AU | 2004215331 | A1 | 9/2004 |
| AU | 2007100530 | A4 | 9/2007 |
| AU | 2007202451 | A9 | 8/2008 |
| AU | 2007202855 | A1 | 1/2009 |
| AU | 2011203287 | A1 | 1/2012 |
| AU | 2010312322 | A1 | 4/2012 |
| AU | 2013100044 | A4 | 2/2013 |
| AU | 2013290356 | A1 | 2/2015 |
| AU | 2013290356 | B2 | 3/2017 |
| AU | 2018203516 | A1 | 1/2019 |
| AU | 2018390893 | A1 | 7/2020 |
| BR | 8201283 | U | 3/2004 |
| BR | 102013022366 | A2 | 8/2015 |
| CN | 2675546 | Y | 2/2005 |
| CN | 2875944 | Y | 3/2007 |
| CN | 101012003 | A | 8/2007 |
| CN | 201012743 | Y | 1/2008 |
| CN | 201012744 | Y | 1/2008 |
| CN | 201023637 | Y | 2/2008 |
| CN | 201086813 | Y | 7/2008 |
| CN | 101300971 | Y | 11/2008 |
| CN | 201220740 | Y | 4/2009 |
| CN | 201291996 | Y | 8/2009 |
| CN | 201300970 | Y | 9/2009 |
| CN | 201300971 | Y | 9/2009 |
| CN | 201329950 | Y | 10/2009 |
| CN | 201331716 | Y | 10/2009 |
| CN | 201347194 | Y | 11/2009 |
| CN | 201390374 | Y | 1/2010 |
| CN | 201406017 | Y | 2/2010 |
| CN | 201406019 | Y | 2/2010 |
| CN | 201406020 | Y | 2/2010 |
| CN | 201407093 | Y | 2/2010 |
| CN | 201407094 | Y | 2/2010 |
| CN | 201415754 | Y | 3/2010 |
| CN | 201437400 | U | 4/2010 |
| CN | 201447051 | U | 5/2010 |
| CN | 101734354 | A | 6/2010 |
| CN | 101734355 | A | 6/2010 |
| CN | 101734356 | A | 6/2010 |
| CN | 101746490 | A | 6/2010 |
| CN | 101870343 | A | 10/2010 |

(56) References Cited

FOREIGN PATENT DOCUMENTS

| | | | | |
|---|---|---|---|---|
| CN | 101870344 | A | | 10/2010 |
| CN | 101870346 | A | | 10/2010 |
| CN | 101871382 | A | | 10/2010 |
| CN | 101927817 | A | | 12/2010 |
| CN | 201914426 | U | | 8/2011 |
| CN | 202264871 | U | | 6/2012 |
| CN | 202574577 | U | | 12/2012 |
| CN | 202574578 | U | | 12/2012 |
| CN | 101875396 | B | | 9/2013 |
| CN | 103373451 | A | | 10/2013 |
| CN | 103373453 | A | | 10/2013 |
| CN | 103419908 | A | | 12/2013 |
| CN | 203381780 | U | | 1/2014 |
| CN | 203567910 | U | | 4/2014 |
| CN | 203593146 | U | | 5/2014 |
| CN | 101879934 | B | | 9/2014 |
| CN | 104229063 | A | | 12/2014 |
| CN | 104229088 | A | | 12/2014 |
| CN | 204056245 | U | | 12/2014 |
| CN | 104260845 | A | | 1/2015 |
| CN | 104260869 | A | | 1/2015 |
| CN | 104295419 | A | | 1/2015 |
| CN | 104309792 | A | * | 1/2015 |
| CN | 204124333 | U | | 1/2015 |
| CN | 204197224 | U | | 3/2015 |
| CN | 204197225 | U | | 3/2015 |
| CN | 204197244 | U | | 3/2015 |
| CN | 204197245 | U | | 3/2015 |
| CN | 204197246 | U | | 3/2015 |
| CN | 204197248 | U | | 3/2015 |
| CN | 204197257 | U | | 3/2015 |
| CN | 204197259 | U | | 3/2015 |
| CN | 204197260 | U | | 3/2015 |
| CN | 204197261 | U | | 3/2015 |
| CN | 204200363 | U | | 3/2015 |
| CN | 204200365 | U | | 3/2015 |
| CN | 204200366 | U | | 3/2015 |
| CN | 204200367 | U | | 3/2015 |
| CN | 204200423 | U | | 3/2015 |
| CN | 204200424 | U | | 3/2015 |
| CN | 204200433 | U | | 3/2015 |
| CN | 204200443 | U | | 3/2015 |
| CN | 204436577 | U | | 7/2015 |
| CN | 204659986 | U | | 9/2015 |
| CN | 103661833 | B | | 3/2016 |
| CN | 205131588 | U | | 4/2016 |
| CN | 105691563 | A | | 6/2016 |
| CN | 205418042 | U | | 8/2016 |
| CN | 205469703 | U | | 8/2016 |
| CN | 205469704 | U | | 8/2016 |
| CN | 104309792 | B | | 9/2016 |
| CN | 105947135 | A | | 9/2016 |
| CN | 105966562 | A | | 9/2016 |
| CN | 105966563 | A | | 9/2016 |
| CN | 105966564 | A | | 9/2016 |
| CN | 105966565 | A | | 9/2016 |
| CN | 106005300 | A | | 10/2016 |
| CN | 106054707 | A | | 10/2016 |
| CN | 205632952 | U | | 10/2016 |
| CN | 106081001 | A | | 11/2016 |
| CN | 205675195 | U | | 11/2016 |
| CN | 206054103 | U | | 3/2017 |
| CN | 104228695 | B | | 4/2017 |
| CN | 206087218 | U | | 4/2017 |
| CN | 106846757 | A | | 6/2017 |
| CN | 206297715 | U | | 7/2017 |
| CN | 206317993 | U | | 7/2017 |
| CN | 206446772 | U | | 8/2017 |
| CN | 206466156 | U | | 9/2017 |
| CN | 206466161 | U | | 9/2017 |
| CN | 206466166 | U | | 9/2017 |
| CN | 206466174 | U | | 9/2017 |
| CN | 206466180 | U | | 9/2017 |
| CN | 206466191 | U | | 9/2017 |
| CN | 206471439 | U | | 9/2017 |
| CN | 206471884 | U | | 9/2017 |
| CN | 206606355 | U | | 11/2017 |
| CN | 105923116 | B | | 1/2018 |
| CN | 107628209 | A | | 1/2018 |
| CN | 206914584 | U | | 1/2018 |
| CN | 206984297 | U | | 2/2018 |
| CN | 207010363 | U | | 2/2018 |
| CN | 107776839 | A | | 3/2018 |
| CN | 207129115 | U | | 3/2018 |
| CN | 107953977 | A | | 4/2018 |
| CN | 207257921 | U | | 4/2018 |
| CN | 207389479 | U | | 5/2018 |
| CN | 207389513 | U | | 5/2018 |
| CN | 108189978 | A | | 6/2018 |
| CN | 207450184 | U | | 6/2018 |
| CN | 207473824 | U | * | 6/2018 |
| CN | 207496901 | U | | 6/2018 |
| CN | 207496902 | U | | 6/2018 |
| CN | 207510694 | U | | 6/2018 |
| CN | 207550443 | U | | 6/2018 |
| CN | 207550444 | U | | 6/2018 |
| CN | 207670628 | U | | 7/2018 |
| CN | 108357650 | A | | 8/2018 |
| CN | 207683736 | U | | 8/2018 |
| CN | 207683737 | U | | 8/2018 |
| CN | 104260846 | B | | 9/2018 |
| CN | 108482604 | A | | 9/2018 |
| CN | 108583797 | A | | 9/2018 |
| CN | 207851575 | U | | 9/2018 |
| CN | 108609124 | A | | 10/2018 |
| CN | 108725709 | A | | 11/2018 |
| CN | 108909963 | A | | 11/2018 |
| CN | 208134578 | U | | 11/2018 |
| CN | 208165225 | U | | 11/2018 |
| CN | 108945331 | A | | 12/2018 |
| CN | 108974272 | A | | 12/2018 |
| CN | 108974298 | A | | 12/2018 |
| CN | 208291439 | U | | 12/2018 |
| CN | 109131766 | A | | 1/2019 |
| CN | 109263823 | A | | 1/2019 |
| CN | 208344507 | U | | 1/2019 |
| CN | 208407991 | B | | 1/2019 |
| CN | 109334888 | A | | 2/2019 |
| CN | 109334889 | A | | 2/2019 |
| CN | 109334890 | A | | 2/2019 |
| CN | 208498755 | U | | 2/2019 |
| CN | 107215436 | B | | 3/2019 |
| CN | 208616170 | U | | 3/2019 |
| CN | 208630821 | U | | 3/2019 |
| CN | 109572954 | A | | 4/2019 |
| CN | 109625200 | A | | 4/2019 |
| CN | 208715417 | U | | 4/2019 |
| CN | 208715431 | U | | 4/2019 |
| CN | 208715437 | U | | 4/2019 |
| CN | 208715455 | U | | 4/2019 |
| CN | 208760858 | U | | 4/2019 |
| CN | 208760859 | U | | 4/2019 |
| CN | 208760860 | U | | 4/2019 |
| CN | 208760861 | U | | 4/2019 |
| CN | 208760862 | U | | 4/2019 |
| CN | 208781922 | U | | 4/2019 |
| CN | 208789898 | U | | 4/2019 |
| CN | 109774891 | A | | 5/2019 |
| CN | 109795610 | A | | 5/2019 |
| CN | 208855842 | U | | 5/2019 |
| CN | 208915389 | U | | 5/2019 |
| CN | 109850090 | A | | 6/2019 |
| CN | 109895964 | A | | 6/2019 |
| CN | 208931601 | U | | 6/2019 |
| CN | 208931604 | U | | 6/2019 |
| CN | 208931605 | U | | 6/2019 |
| CN | 208931617 | U | | 6/2019 |
| CN | 209000208 | U | | 6/2019 |
| CN | 110039578 | A | | 7/2019 |
| CN | 209159955 | U | | 7/2019 |
| CN | 209176872 | U | | 7/2019 |
| CN | 110085788 | A | | 8/2019 |
| CN | 110171092 | A | | 8/2019 |
| CN | 110182331 | A | | 8/2019 |

(56) References Cited

FOREIGN PATENT DOCUMENTS

| | | | | | |
|---|---|---|---|---|---|
| CN | 209253549 | U | | 8/2019 | |
| CN | 209258326 | U | | 8/2019 | |
| CN | 209258351 | U | | 8/2019 | |
| CN | 209258352 | U | | 8/2019 | |
| CN | 209280091 | | | 8/2019 | |
| CN | 209290629 | U | | 8/2019 | |
| CN | 107128454 | B | | 9/2019 | |
| CN | 107933845 | B | | 9/2019 | |
| CN | 110239687 | A | | 9/2019 | |
| CN | 209366402 | U | | 9/2019 | |
| CN | 209366403 | U | | 9/2019 | |
| CN | 209366404 | U | | 9/2019 | |
| CN | 209366405 | U | | 9/2019 | |
| CN | 209366406 | U | | 9/2019 | |
| CN | 209366407 | U | | 9/2019 | |
| CN | 209366408 | U | | 9/2019 | |
| CN | 209369930 | U | | 9/2019 | |
| CN | 209385232 | U | | 9/2019 | |
| CN | 209441573 | U | | 9/2019 | |
| CN | 110350341 | A | | 10/2019 | |
| CN | 110356524 | A | | 10/2019 | |
| CN | 110362080 | A | | 10/2019 | |
| CN | 209454955 | U | | 10/2019 | |
| CN | 209479921 | U | | 10/2019 | |
| CN | 110406642 | A | | 11/2019 | |
| CN | 110481728 | A | | 11/2019 | |
| CN | 209581796 | U | | 11/2019 | |
| CN | 209581797 | U | | 11/2019 | |
| CN | 209581798 | U | | 11/2019 | |
| CN | 209600753 | U | | 11/2019 | |
| CN | 110562408 | A | | 12/2019 | |
| CN | 209739293 | U | | 12/2019 | |
| CN | 209766523 | U | | 12/2019 | |
| CN | 209833934 | U | | 12/2019 | |
| CN | 209833939 | U | | 12/2019 | |
| CN | 108407991 | B | | 1/2020 | |
| CN | 110683005 | A | | 1/2020 | |
| CN | 209913096 | U | | 1/2020 | |
| CN | 209921564 | U | | 1/2020 | |
| CN | 209921565 | U | | 1/2020 | |
| CN | 209938884 | U | | 1/2020 | |
| CN | 110816758 | A | | 2/2020 | |
| CN | 110844006 | A | | 2/2020 | |
| CN | 210068712 | U | | 2/2020 | |
| CN | 110911888 | A | | 3/2020 | |
| CN | 110920812 | A | | 3/2020 | |
| CN | 110920813 | A | | 3/2020 | |
| CN | 110920847 | A | | 3/2020 | |
| CN | 210149516 | U | | 3/2020 | |
| CN | 210149517 | U | | 3/2020 | |
| CN | 210212690 | U | | 3/2020 | |
| CN | 210212691 | U | | 3/2020 | |
| CN | 110949620 | A | | 4/2020 | |
| CN | 210310790 | U | | 4/2020 | |
| CN | 210364284 | U | | 4/2020 | |
| CN | 210364287 | U | | 4/2020 | |
| CN | 210478964 | U | | 5/2020 | |
| CN | 210478965 | U | | 5/2020 | |
| CN | 210478967 | U | | 5/2020 | |
| CN | 210503084 | U | | 5/2020 | |
| CN | 210526789 | U | | 5/2020 | |
| CN | 110901869 | B | | 6/2020 | |
| CN | 111268038 | A | | 6/2020 | |
| CN | 111284636 | A | | 6/2020 | |
| CN | 210806779 | U | | 6/2020 | |
| CN | 210852818 | U | | 6/2020 | |
| CN | 210971446 | U | | 7/2020 | |
| CN | 211018557 | U | | 7/2020 | |
| CN | 211126279 | U | | 7/2020 | |
| CN | 211139588 | U | | 7/2020 | |
| CN | 211336359 | U | | 8/2020 | |
| CN | 211364859 | U | | 8/2020 | |
| CN | 109795610 | B | | 11/2020 | |
| DE | 3634775 | | | 4/1988 | |
| DE | 10103126 | | | 9/2002 | |
| DE | 202006000210 | U1 | | 3/2006 | |
| DE | 202007003106 | U1 | | 7/2007 | |
| DE | 202010000559 | U1 | | 6/2010 | |
| DE | 102010032014 | A1 | | 1/2012 | |
| DE | 202013007100 | U1 | | 9/2013 | |
| DE | 202014006552 | U1 | | 11/2014 | |
| DE | 102014005314 | A1 | | 10/2015 | |
| DE | 202017103703 | U1 | | 7/2017 | |
| DE | 202017107819 | U1 | | 1/2018 | |
| DE | 202017107820 | U1 | | 1/2018 | |
| DE | 202017107821 | U1 | | 1/2018 | |
| DE | 202017107824 | U1 | | 1/2018 | |
| DE | 202017107826 | U1 | | 1/2018 | |
| DE | 102018113137 | A1 | | 2/2019 | |
| DE | 102017130946 | A1 | | 6/2019 | |
| DE | 102017130949 | A1 | | 6/2019 | |
| DE | 102017130955 | A1 | | 6/2019 | |
| DE | 102017130959 | A1 | | 6/2019 | |
| DE | 102017130963 | A1 | | 6/2019 | |
| DE | 102017130966 | A1 | | 6/2019 | |
| DE | 102018100696 | A1 | | 6/2019 | |
| DE | 202019103496 | U1 | | 9/2019 | |
| DE | 202018104741 | U1 | | 11/2019 | |
| DE | 102018215176 | A1 | | 3/2020 | |
| DE | 102018127650 | A1 | | 5/2020 | |
| EP | 1538074 | A1 | * | 6/2005 | ..... B63H 25/02 |
| EP | 2693284 | A2 | * | 2/2014 | ..... A63H 30/04 |
| EP | 3041735 | A1 | | 7/2016 | |
| EP | 1955025 | B1 | | 3/2017 | |
| EP | 3526112 | A1 | | 8/2019 | |
| EP | 3526113 | A1 | | 8/2019 | |
| EP | 3529142 | A1 | | 8/2019 | |
| EP | 3529143 | A1 | | 8/2019 | |
| EP | 3552947 | A1 | | 10/2019 | |
| EP | 3277574 | B1 | | 11/2019 | |
| EP | 3640882 | A1 | | 4/2020 | |
| EP | 3747754 | | | 12/2020 | |
| EP | 4180316 | A1 | * | 5/2023 | ..... B63B 32/10 |
| ES | 1153639 | Y | | 7/2016 | |
| FR | 3078680 | B1 | | 5/2020 | |
| GB | 2132773 | | | 7/1984 | |
| GB | 2580022 | A | | 7/2020 | |
| GB | 2627370 | A | * | 8/2024 | ..... B63B 79/40 |
| HK | 1250973 | A1 | | 1/2019 | |
| IN | 200701396 | I2 | | 7/2008 | |
| JP | 2002154479 | A | | 5/2002 | |
| JP | 2002193185 | A | | 7/2002 | |
| JP | 2008189169 | A | | 8/2008 | |
| JP | 2008230315 | A | | 10/2008 | |
| JP | 2009018702 | A | | 1/2009 | |
| JP | 2010173405 | A | | 8/2010 | |
| JP | 3163820 | U | | 11/2010 | |
| JP | 4640760 | B2 | | 3/2011 | |
| JP | 3183445 | U | | 5/2013 | |
| JP | 5221737 | B2 | | 6/2013 | |
| JP | 2014043150 | A | | 3/2014 | |
| JP | 5791376 | B2 | | 10/2015 | |
| JP | 2015177735 | | | 10/2015 | |
| JP | 2020111331 | A | | 7/2020 | |
| KR | 100560702 | B1 | | 3/2006 | |
| KR | 100572804 | B1 | | 4/2006 | |
| KR | 100581491 | B1 | | 5/2006 | |
| KR | 20090006619 | A | | 1/2009 | |
| KR | 20090098306 | A | | 9/2009 | |
| KR | 20100010874 | U | | 11/2010 | |
| KR | 101024595 | B1 | | 3/2011 | |
| KR | 200454353 | Y1 | | 6/2011 | |
| KR | 101491661 | B1 | | 2/2015 | |
| KR | 20160027555 | A | | 3/2016 | |
| KR | 20160057060 | A | | 5/2016 | |
| KR | 101697338 | B1 | | 1/2017 | |
| KR | 101713936 | B1 | | 3/2017 | |
| KR | 101767476 | B1 | | 8/2017 | |
| KR | 20170090702 | A | | 8/2017 | |
| KR | 101857099 | B1 | | 5/2018 | |
| KR | 20190063727 | A | | 6/2019 | |
| KR | 101978043 | B1 | | 8/2019 | |
| KR | 102052195 | B1 | | 12/2019 | |
| KR | 102050718 | B1 | | 1/2020 | |

(56) References Cited

FOREIGN PATENT DOCUMENTS

| | | | | |
|---|---|---|---|---|
| KR | 200490972 | | 1/2020 | |
| KR | 102095292 | B1 | 3/2020 | |
| KR | 102095294 | B1 | 3/2020 | |
| KR | 102103228 | B1 | 4/2020 | |
| KR | 102103229 | B1 | 4/2020 | |
| KR | 102116532 | B1 | 6/2020 | |
| KR | 102133778 | B1 | 7/2020 | |
| NO | 20181547 | A1 | 6/2020 | |
| PL | 3277574 | T3 | 6/2020 | |
| TW | M257328 | U | 2/2005 | |
| TW | M308901 | U | 4/2007 | |
| TW | 200848320 | A | 12/2008 | |
| TW | 201000361 | A | 1/2010 | |
| TW | 1334793 | B | 12/2010 | |
| TW | M461592 | U | 9/2013 | |
| TW | 1605324 | B | 11/2017 | |
| TW | M552465 | U | 12/2017 | |
| WO | 2002092420 | A1 | 11/2002 | |
| WO | 2005058685 | A1 | 6/2005 | |
| WO | 2006014085 | A1 | 2/2006 | |
| WO | 2006042359 | A1 | 4/2006 | |
| WO | 2007072185 | A2 | 6/2007 | |
| WO | 2008022863 | | 2/2008 | |
| WO | 2009144400 | A2 | 12/2009 | |
| WO | 2011047431 | A1 | 4/2011 | |
| WO | 2011049470 | | 4/2011 | |
| WO | 2012013770 | A2 | 2/2012 | |
| WO | 2013026714 | A1 | 2/2013 | |
| WO | 2015033032 | | 3/2015 | |
| WO | 2015039970 | A1 | 3/2015 | |
| WO | 2016003121 | A1 | 1/2016 | |
| WO | 2017069322 | A1 | 4/2017 | |
| WO | WO-2017091537 | A1 * | 6/2017 | ..... F02B 75/02 |
| WO | 2017153338 | A1 | 9/2017 | |
| WO | 2017221233 | A1 | 12/2017 | |
| WO | 2018149044 | A1 | 8/2018 | |
| WO | 2018234969 | A1 | 12/2018 | |
| WO | 2019072196 | A1 | 4/2019 | |
| WO | 2019073126 | A1 | 4/2019 | |
| WO | 2019122087 | A1 | 6/2019 | |
| WO | 2019122091 | A1 | 6/2019 | |
| WO | 2019122098 | A1 | 6/2019 | |
| WO | 2019122176 | A1 | 6/2019 | |
| WO | 2019122185 | A1 | 6/2019 | |
| WO | 2019122225 | A1 | 6/2019 | |
| WO | 2019122321 | A1 | 6/2019 | |
| WO | 2019129687 | A1 | 7/2019 | |
| WO | 2019141799 | A1 | 7/2019 | |
| WO | 2019143276 | A1 | 7/2019 | |
| WO | 2019183668 | A1 | 10/2019 | |
| WO | 2019203135 | A1 | 10/2019 | |
| WO | 2019222119 | A1 | 11/2019 | |
| WO | 2020042299 | A1 | 3/2020 | |
| WO | 2020042300 | A1 | 3/2020 | |
| WO | 2020042301 | A1 | 3/2020 | |
| WO | 2020042302 | A1 | 3/2020 | |
| WO | 2020056822 | A1 | 3/2020 | |
| WO | 2020056823 | A1 | 3/2020 | |
| WO | 2020107665 | A1 | 6/2020 | |
| WO | 2020113768 | A1 | 6/2020 | |
| WO | 2020176033 | A1 | 9/2020 | |
| WO | 2021191729 | | 9/2021 | |
| WO | 2022037809 | | 2/2022 | |
| WO | WO-2022174296 | A1 * | 8/2022 | ..... B63B 32/66 |
| WO | 2022265968 | | 12/2022 | |
| WO | WO-2023094668 | A1 * | 6/2023 | ..... B63H 21/17 |
| WO | WO-2024170899 | A1 * | 8/2024 | ..... B63B 79/40 |

OTHER PUBLICATIONS

Asa Bonthelius, "Hoglage," BATNYTT (Sep. 2009).

European Search Report for Application No. 22206528.6 dated Apr. 11, 2023.

European Search Report in corresponding European Patent Application EP 18163734.9, dated Sep. 19, 2018.

Evolo Final Report, Apr. 23, 2009.

International Search Report in corresponding PCT/US2018/023959 dated Jul. 3, 2018.

JetSurfing Nation jet boards & efoils, "Awake RAVIK Premium Electric Surfboard—unboxing and review Part 1," https://www.youtube.com/watch?v=i3P9NWw4fpg, Oct. 1, 2019.

Ray Vellinga, "Hydrofoil—Thrilling Swedish Invention," https://www.youtube.com/watch?V=klAggNlir9A&feature=youtu.be, Oct. 27, 2011.

Scrapheaper, "Trampfoil—the 'originals* from Sweden," https://www.youtube.com/watch?v=QQvYogFP9mw&feature=youtu.be, Aug. 15, 2010.

Patent Cooperation Treaty, International Searching Authority, Notification of Transmittal of the International Search Report and the Written Opinion of the International Searching Authority, or the Declaration and the Written Opinion of the International Searching Authority issued in International Application No. PCT/US24/20151, Aug. 15, 2024, 25 pp.

Patent Cooperation Treaty, International Searching Authority, Notification of Transmittal of the International Search Report and the Written Opinion of the International Searching Authority, or the Declaration and the Written Opinion of the International Searching Authority issued in International Application No. PCT/US24/20180, Aug. 13, 2024, 23 pp.

Autodesk Instructables, "Building an Arduino Water Level Detection Sensor," presently believed to be publicly available at least before Mar. 20, 2023, 7 pages.

Level Hydrofoils, Wayback Machine, Archive of https://www.levelfoils.com/technology , dated Sep. 29, 2022, 7 pages.

Omron, "Technical Explanation for Level Controllers," presently believed to be publicly available at least before Mar. 20, 2023, 31 pages.

Taaroa Hydrofoil, Wayback Machine, Archive of https://www.taaroa-hydrofil.com/iup-product dated Dec. 2, 2022, 5 pages.

Patent Cooperation Treaty, International Searching Authority, Notification of Transmittal of the International Search Report and the Written Opinion of the International Searching Authority, or the Declaration and the Written Opinion of the International Searching Authority issued in International Application No. PCT/US24/15128, Jul. 23, 2024, 16 pp.

Zapata Racing, Manuel Kit Electronique Wireless, Believed to be publicly available before Sep. 12, 2016, 37 pages.

* cited by examiner

WATERCRAFT DEVICE WITH A HANDHELD CONTROLLER

RELATED APPLICATIONS

This application claims the benefit of U.S. Application No. 63/445,404, filed Feb. 14, 2023, the contents of which are incorporated herein by its entirety.

FIELD

This disclosure relates to electrically propelled watercraft devices and, more particularly, to apparatus and methods for controlling such watercraft devices and other motor driven devices.

BACKGROUND

Some watercraft include hydrofoils that extend below a board or inflatable platform on which a user rides. One such hydrofoiling watercraft is disclosed in U.S. Pat. No. 10,940,917, which is incorporated herein by reference in its entirety. Many existing hydrofoiling watercraft include a battery in a cavity of the board and an electric motor mounted to a strut of the hydrofoil to propel the watercraft, with power wires extending within the strut between the battery and the electric motor.

Existing hydrofoiling watercraft (such as the watercraft is disclosed in U.S. Pat. No. 10,940,917) require the rider to simultaneously operate a remote controller to control the throttle of the watercraft while controlling the direction and ride height of the watercraft by shifting their weight relative to the watercraft. For example, existing watercraft are steered by the rider shifting their weight to one side of the board or the other. If the rider overcompensates in any direction, they may fall from the watercraft. As a result, riders must keep their balance while simultaneously operating a remote controller to control the throttle of the hydrofoiling watercraft and shifting their weight to steer the watercraft. As a result, operating the watercraft requires skill and experience. The inventors have identified a need for improvements to the way the hydrofoiling watercraft is controlled, to make the hydrofoiling watercraft easier to operate or ride. Existing remote controllers for hydrofoiling watercraft lack customizability to suit preferences of individual riders.

Existing throttle controllers for hydrofoiling watercraft may have a trigger that the user pulls or squeezes to control the throttle. To solve shortcomings associated with such triggers, U.S. Patent Application Publication No. 2022/0063786, filed on Nov. 10, 2021 and incorporated herein by reference in its entirety, discloses a thumb-wheel used to control the throttle. Such thumb-wheels may be non-intuitive for certain users who are more familiar with trigger-based throttle controllers. Known devices do not provide a means for configuring the controller according to the user's preference. Further, both thumb-wheel and trigger-based controllers have certain disadvantages. For example, because a single finger is used to control the trigger or thumb-wheel, it is difficult or impossible to shift position of that finger on the input (i.e. the thumb-wheel or the trigger) without releasing the input and causing the hydrofoiling watercraft to come to a stop.

Another shortcoming of certain existing remote controllers, for watercraft and other motor driven vehicles (e.g., electric skateboards), is that the remote controllers are not able to filter out stray magnetic flux and noise from external magnets (e.g., magnetic screwdriver tip, etc.). For example, many existing remote controllers include a single axis Hall effect sensor that detects the magnitude of the flux from a magnet coupled to a trigger. As the trigger moves when the trigger is squeezed, the magnitude of the magnetic flux changes as the magnet of the trigger is brought in proximity to or moved away from the single axis Hall effect sensor. A throttle control signal is then generated based on the magnitude of the flux detected by the single axis Hall effect sensor. Such remote controllers are thus prone to generating throttle control signals in response to any magnetic flux that is detected by the Hall effect sensor. As a result, these existing remote controllers undesirably send throttle control signals to the motor in response to the detection of such external magnetic flux.

DETAILED DESCRIPTION

Figure 1A:
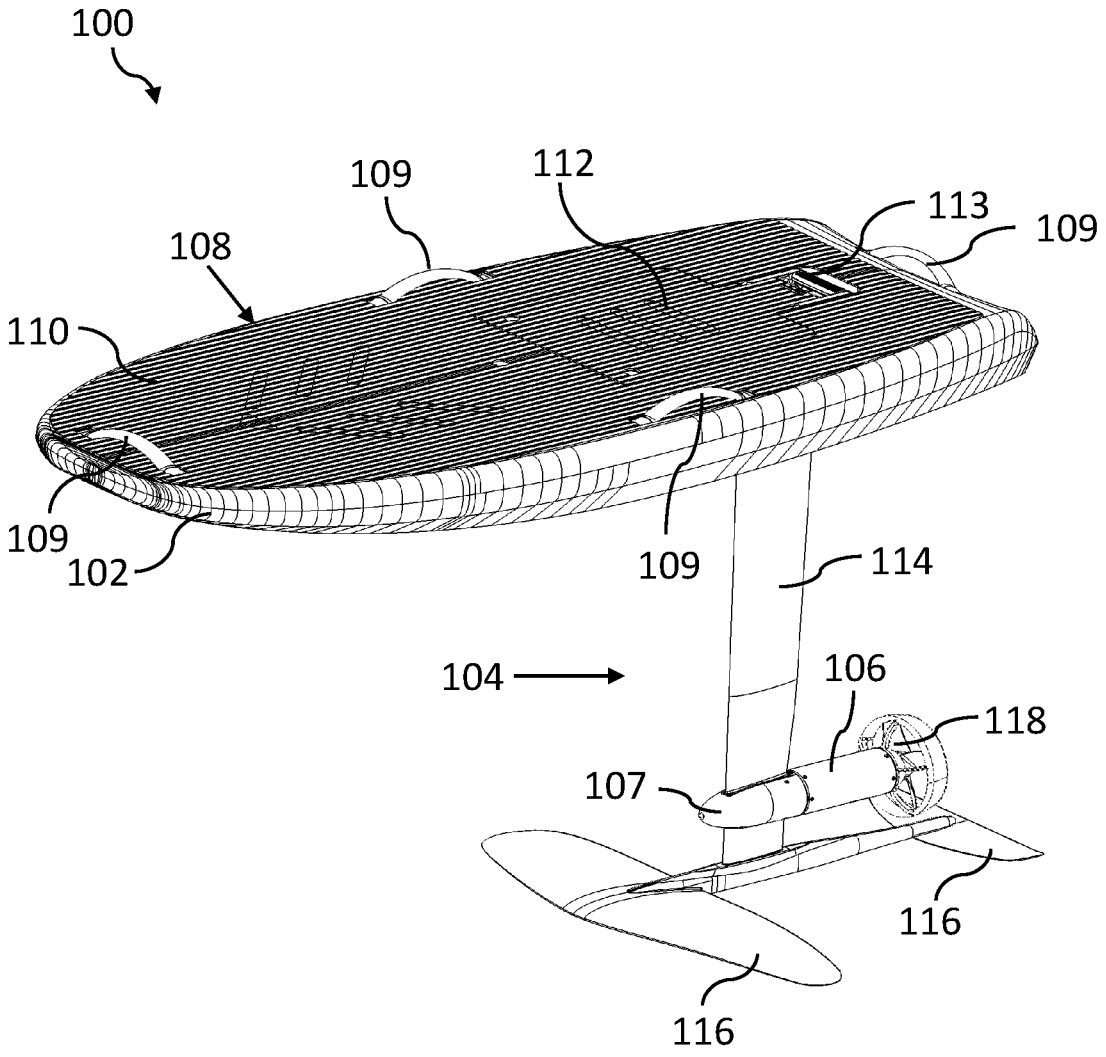
FIG. 1A is a front perspective view of a hydrofoiling watercraft having a board, a hydrofoil, and an electric propulsion system.
Figure 1B:
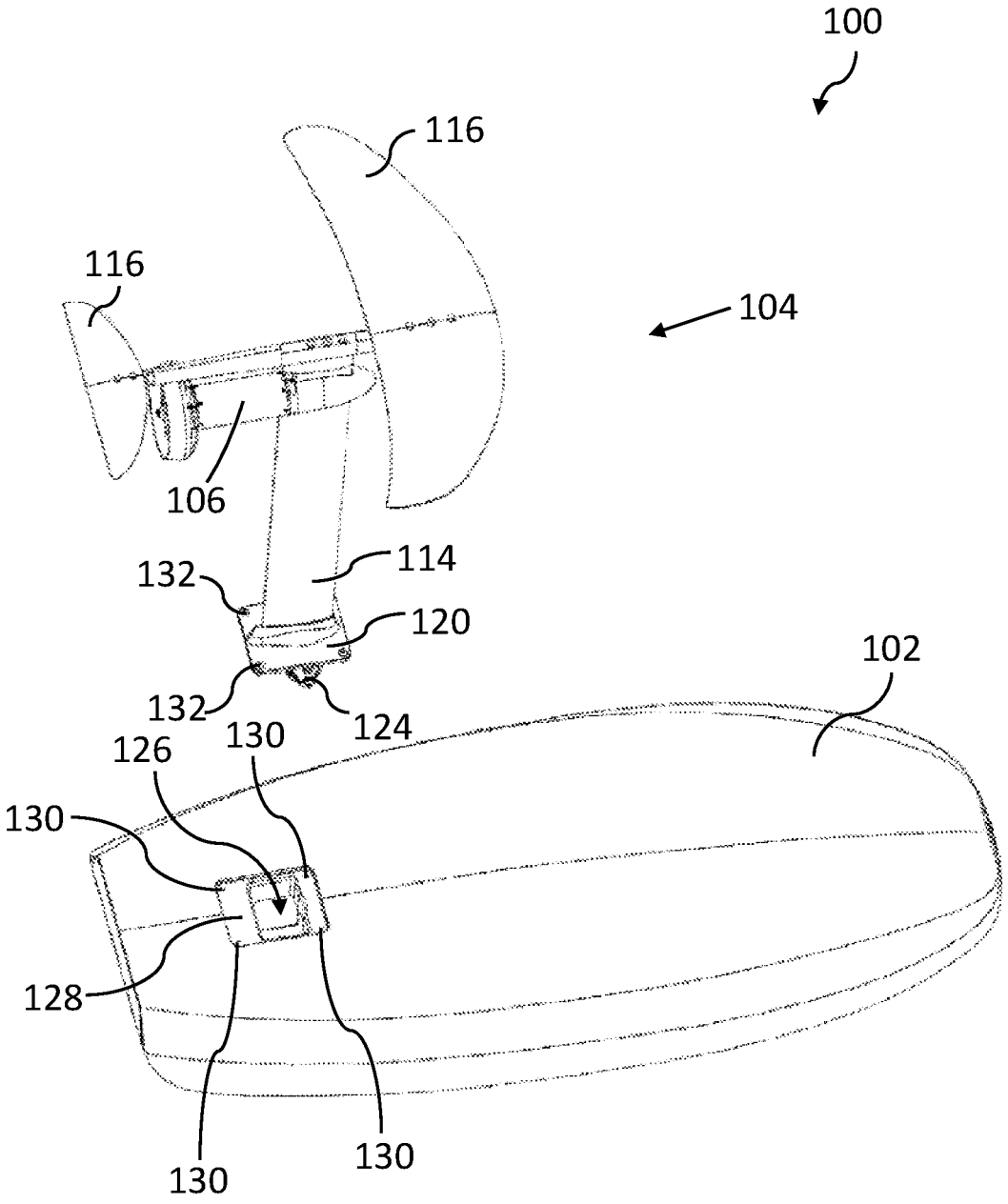
FIG. 1B is a bottom perspective view of the hydrofoiling watercraft of FIG. 1A shown with the hydrofoil detached from the board.

With reference to FIGS. 1A-1B, a hydrofoiling watercraft 100 is shown having a board 102, a hydrofoil 104, and an electric propulsion unit 106 mounted to the hydrofoil 104. The board 102 may be a rigid board formed of fiberglass, carbon fiber or a combination thereof, or an inflatable board. The top surface of the board 102 forms a deck 108 on which a user or rider may lay, sit, kneel, or stand to operate the watercraft 100. The deck 108 may include a deck pad comprising a rubber layer 110 affixed to the top surface of the board 102 to provide increased friction for the rider when the rider is on the deck 108. The deck 108 may thus aid to prevent the rider from slipping on the deck 108 during operation or when the deck 108 becomes wet. The rubber layer 110 may include ridges and/or grooves extending along the length of the deck 108. The board 102 may further include carrying handles 109 that aid in transporting the board 102. In one embodiment, handles 109 are retractable such that the handles are drawn flush with the board 102 when not in use. The handles 109 may be extended outward when needed to transport the board 102.

The hydrofoiling watercraft 100 may further include a battery box 112 that is mounted into a cavity 113 on the top side of the board 102. The battery box 112 may house a battery for powering the watercraft 100, an intelligent power unit (IPU) that controls the power provided to the electric propulsion unit 106, communication circuitry, Global Navigation Satellite System (GNSS) circuitry, and/or a computer (e.g., processor and memory) for controlling the watercraft or processing data collected by one or more sensors of the watercraft 100. The watercraft 100 may determine the location of the watercraft at any given time using the GNSS circuitry. The communication circuitry may be configured to communicate with a wireless remote controller, such as the wireless handheld remote controllers 400, 500 of FIGS. 4 and 7A discussed below.

The communication circuitry may further be configured to communicate via Bluetooth, cellular, Wi-Fi, Zigbee and the like. The IPU or computer may communicate with remote devices via the communication circuitry. For example, the communication circuitry may also enable the watercraft 100 to communicate with a server computer.

The hydrofoil 104 includes a strut 114 and one or more hydrofoil wings 116. The propulsion unit 106 may be mounted to the strut 114. The propulsion unit 106 may be mounted to the strut 114 by a bracket 107 that permits the propulsion unit 106 to be mounted to or clamped onto the strut 114 at varying heights or positions along the strut. Power wires and a communication cable may extend through the strut 114 from the battery box 112 to provide power and operating instructions to the propulsion unit 106. The propulsion unit 106 may contain an electronic speed controller (ESC) and a motor. In some embodiments, the propulsion unit 106 also includes the battery and/or the IPU. The motor includes a shaft that is coupled to a propeller 118. The ESC provides power to the motor based on the control signals received from the IPU of the battery box 112 to operate the motor and cause the shaft of the motor to rotate. Rotation of the shaft turns the propeller which drives the watercraft through the water. In other forms, a waterjet may be used in place of the propeller to drive the watercraft through the water.

As the hydrofoiling watercraft 100 is driven through the water by way of the motor, the water flowing over the hydrofoil wings 116 provides lift. This causes the board 102 to rise above the surface of the water when the watercraft 100 is operated at or above certain speeds such that sufficient lift is created. While the hydrofoil wings 116 are shown mounted to the base of the strut 114, in other forms, the hydrofoil wings 116 may extend from the propulsion unit 106. The propulsion unit 106 thus may be a fuselage from which hydrofoil wings 116 extend. In some forms, the hydrofoil wings 116 are mounted above the propulsion unit 106 and closer to the board 102 than the propulsion unit 106. In some forms, the hydrofoil wings 116 and/or the propulsion unit 106 include movable control surfaces that may be adjusted to provide increased or decreased lift and/or to steer the watercraft 100. For instance, the movable control surfaces may be pivoted to adjust the flow of fluid over the hydrofoil wing or the propulsion unit 106 to adjust the lift provided by the hydrofoil wing, increase the drag, and/or turn the watercraft 100. The wings 116 may include an actuator, such as a motor, linear actuator or dynamic servo, that is coupled to the movable control surface and configured to move the control surfaces between various positions. The position of the movable control surface may be adjusted by a computer of the watercraft 100, for instance, the IPU or propulsion unit 106. The actuators may receive a control signal from a computing device of the watercraft 100 via the power wires and/or a communication cable extending through the strut 114 and/or the wings 116 to adjust to the position of the control surfaces. The computing device may operate the actuator and cause the actuator to adjust the position of one or more movable control surfaces. The position of the movable control surfaces may be adjusted to maintain a ride height of the board 102 of the watercraft above the surface of the water.

Figure 2:
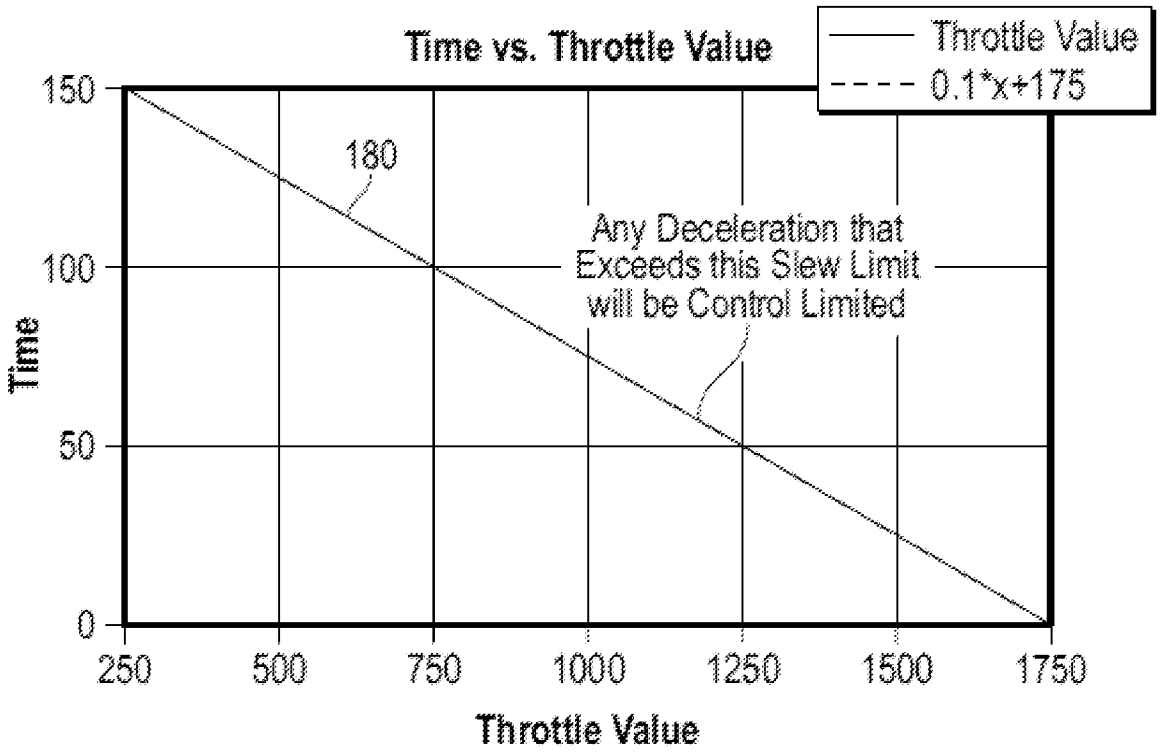
FIG. 2 is a graph indicating an example deceleration limit line permitted by the hydrofoiling watercraft of FIG. 1A according to an embodiment.

The watercraft 100 may be configured to control the rate of deceleration of the watercraft 100 so that the watercraft 100 does not abruptly decelerate (which may cause the rider to fall), but instead has a smooth transition to a slower speed or to a stop. For example, when the rider releases the throttle, the IPU may be configured to continue rotating the propeller at progressively decreasing speeds to lower the rate of deceleration. Using this approach, the rider experiences a smooth transition toward a slower speed without the watercraft 100 jerking in response to the rider easing up on the throttle. The watercraft 100 thus provides an artificial glide to the watercraft 100 when the user disengages or reduces the throttle control value. With reference to FIG. 2, an example graph is provided showing an example slew limit line 180 that may be used to control the rate of deceleration based on the throttle values provided from the throttle controller of a remote controller 500. If the throttle values received from the rider's controller decrease at a rate that is steeper than the slope of the slew limit line 180, then the IPU or motor controller will increase the throttle value provided to the motor to ensure that the motor of the watercraft 100 does slow at a rate slower than the slew limit line 180. The ensures that the watercraft 100 does not slow abruptly, but rather slows at a rate no greater than the slew limit line 180.

Figure 3:
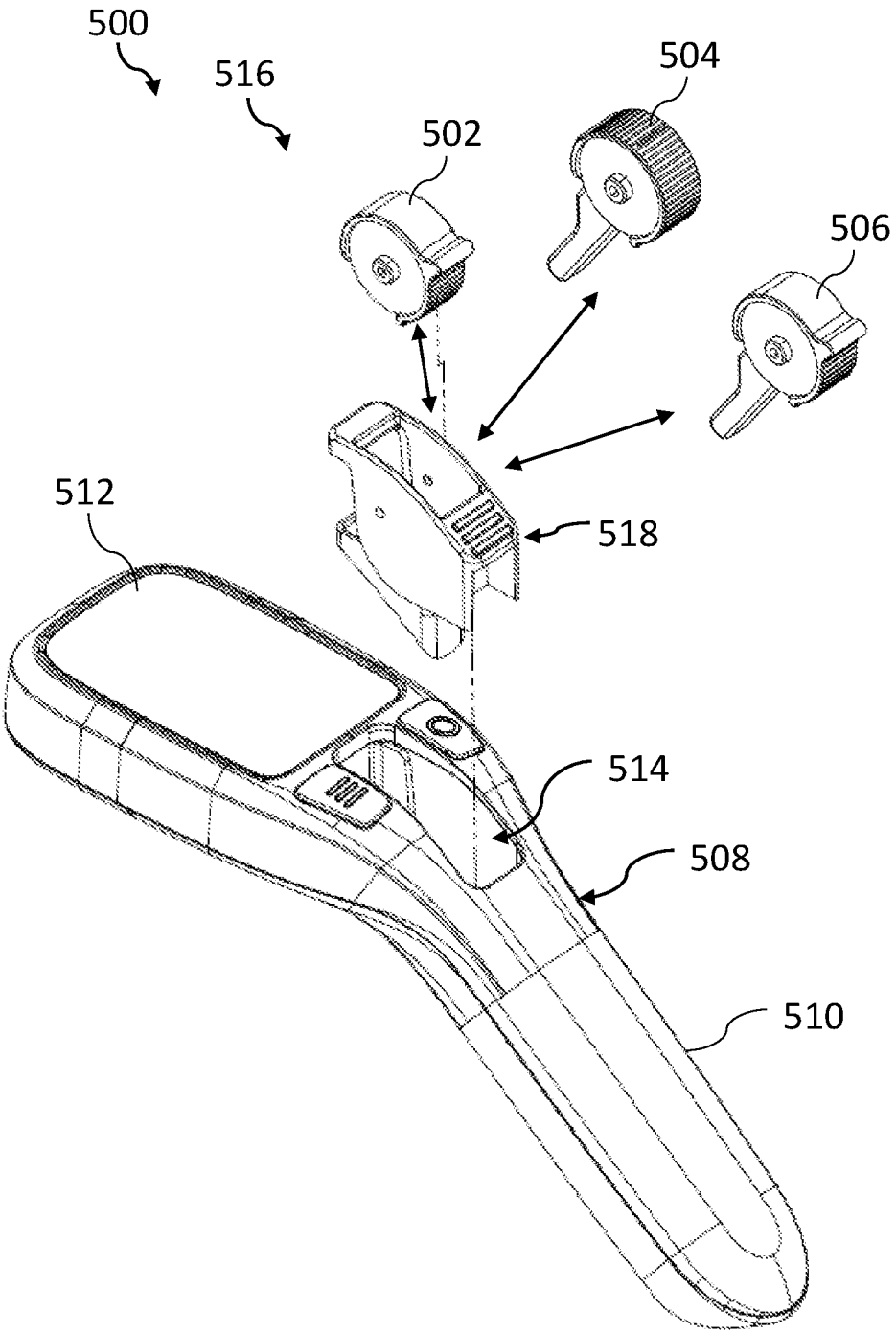
FIG. 3 is an exploded, perspective view of a remote controller for controlling the operation of the hydrofoiling watercraft of FIG. 1A that is compatible with various throttle control interfaces.

With respect to FIG. 3, a wireless remote controller 500 for controlling the watercraft 100 is provided. The remote controller 500 is compatible with multiple types of throttle control interfaces including, as examples, a thumbwheel interface 502, a trigger interface 504, and a thumbwheel/trigger interface 506 as described in further detail below. The remote controller 500 may be similar in many respects to the remote controllers disclosed in U.S. Patent Application Publication No. 2022/0063786, the contents of which are incorporated by reference herein in its entirety.

The remote controller 500 has a housing 508 having a gripping portion such as handle 510, a display portion 512, and a cavity or through hole 514 for receiving a throttle control interface assembly 516. The throttle control interface assembly 516 includes the throttle control interface 502, 504, 506 and a cartridge 518 into which the selected throttle control interface is loaded. The cartridge 518 is inserted into the through hole 514 and removably secured to the housing 508 of the remote controller 500. The cartridge 518 may be withdrawn from the housing 508 and/or a new or different throttle control interface 502, 504, 506 loaded into the cartridge to change the type of throttle control interface of the remote controller 500.

Figure 4A:
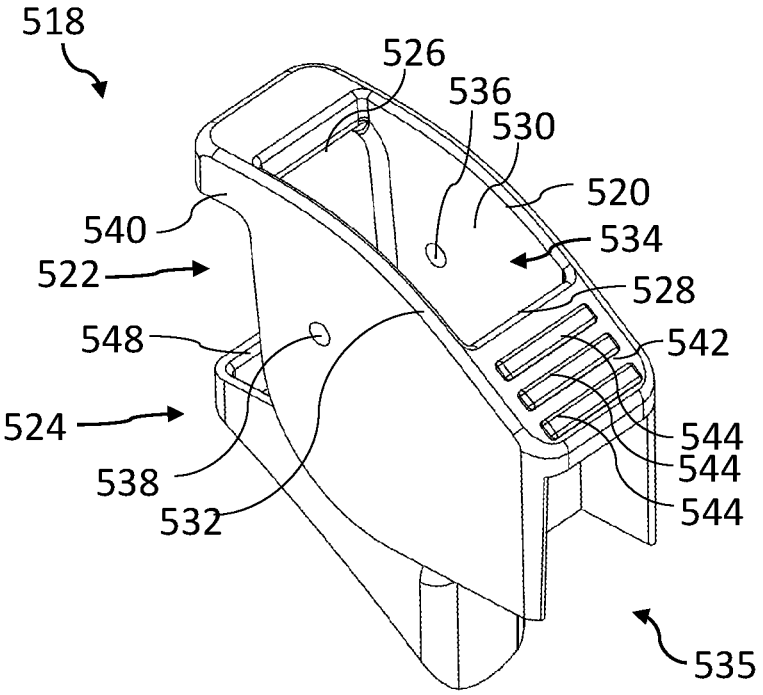
FIG. 4A is a top perspective view of a cartridge of the remote controller of FIG. 3.
Figure 4B:
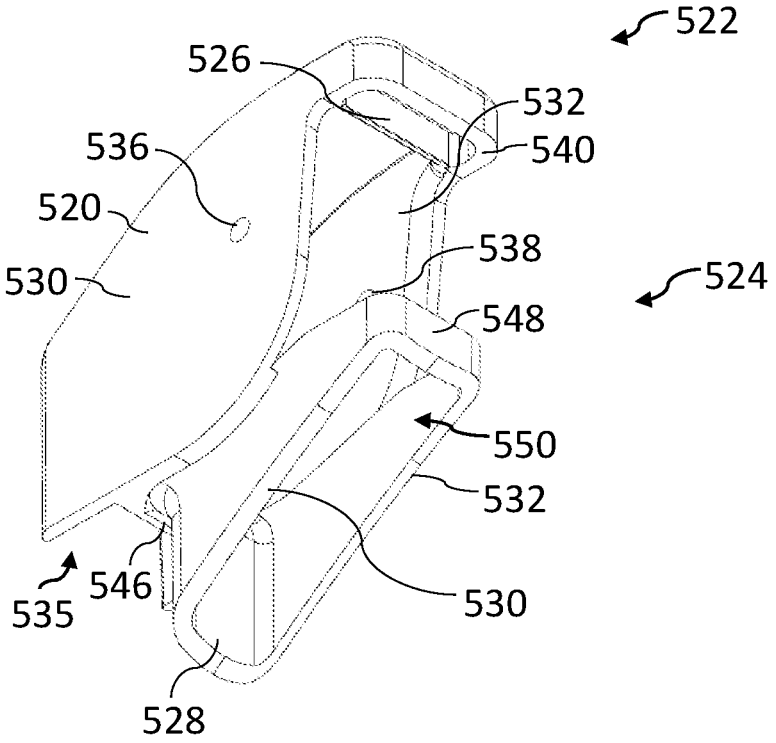
FIG. 4B is a bottom perspective view of the cartridge of FIG. 4A.

With respect to FIGS. 4A-4B, the cartridge 518 includes a body 520 having an upper portion 522 and a lower portion 524. The upper portion 522 is configured to receive an outer body (e.g. 570, 600, 620) of the control interface 502, 504, 506. The upper portion 522 of the body 520 includes a front wall 526, a rear wall 528, and sidewalls 530, 532 extending from the front wall 526 to the rear wall 528 and defining an opening or cavity 534 for receiving the throttle control interface 502, 504, 506. The sidewalls 530, 532 include holes 536, 538 that may be used to secure the throttle control interface in the cartridge 518. For example, a screw axle may be extended into the holes 536, 538 and an opening 577 of the throttle control interface 502, 504, 506 (see, e.g., FIG. 5) to secure the throttle control interface to the cartridge 518. As another example, the interior surface of the sidewalls 530, 532 may include recesses into which ends of the support rod 574 are received to connect the throttle control interface to the cartridge 518. As yet another example, fasteners such as screws may be inserted through the holes 536, 538 of the sidewalls 530, 532 and into opening 577 of the throttle control interface. As yet another example, the throttle control interface 502, 504, 506 is press fit into the cavity 534 of the cartridge 518. For instance, the ends of the support rod 574 frictionally engage the interior surface of the sidewalls 530, 532 of the cartridge 518 to fix the support rod 574 to the cartridge 518 with the outer body 570 rotatable relative to the support rod 574 and the cartridge 518.

The upper portion 522 of the body 520 has a front lip 540 that extends from the front wall 526. The sidewalls 530, 532 may extend rearward of the rear wall 528 to form a channel 535 at the rear end of the body 520. The upper portion 522 may include an upper surface 542 rearward of the cavity 534 and above the channel 535. The upper surface 542 may include one or more ridges 544 extending laterally across the upper surface 542. The upper surface 542 may provide the user with a surface to rest a finger (e.g., their thumb) when not engaging the throttle control interface. The ridges 544 may provide the user with increased grip and/or tactile orientation to aid the user in holding the remote controller 500 when the cartridge 518 is installed in the remote controller 500.

The lower portion 524 is configured to receive a trigger portion of certain control interface 504, 506 and to pass the trigger portion through the housing 508 of the remote controller 500. The rear wall 528 and sidewalls 530, 532 of the cartridge 518 extend to the lower portion 524 of the body 520 of the cartridge 518. The rear wall 528 and sidewalls 530, 532 extend inward from the upper portion 522 of the body 520 to the lower portion 524 of the body 520 such that the lower portion 524 of the body 520 is narrower than the upper portion 522. The rear wall 528 has a step 546 such that the upper portion of the rear wall 528 is rearward of the lower portion of the rear wall 528. The lower portion 524 of the body 520 includes a front wall 548, the rear wall 528, and the sidewalls 530, 532 that form an opening 550. The lower portion 524 is sized to be positioned within the through hole 514 of the remote controller 500 at the lower side of the housing 508. In some forms, the lower portion 524 of the cartridge 518 includes a bottom wall (not shown) covering the opening 550. The bottom wall may be profiled to extend along the lower side of the housing 508 of the remote controller 500 when the cartridge 518 is installed therein to close the through hole 514 on the lower side of the housing 508. The bottom wall may be removably attachable to the lower portion 524 of the cartridge 518 to close the bottom of the cartridge 518 when the thumbwheel interface 502 (or a throttle control interface without a trigger) is installed in the cartridge 518. The bottom wall may be configured to be removably snapped into the opening 550.

The cartridge 518 may be inserted into the through hole 514 of the housing 508 of the remote controller 500 to attach the cartridge 518 to the remote controller as discussed in further detail below. Where the throttle control interface 502, 504, 506 is inserted into the cartridge 518, inserting and attaching the cartridge 518 to the housing 508 of the remote controller 500 positions the throttle control interface in proximity to a sensor 501 of the remote controller 500 that is able to detect the position of the throttle control interface to control an associated device, e.g., watercraft 100.

Figure 5A:
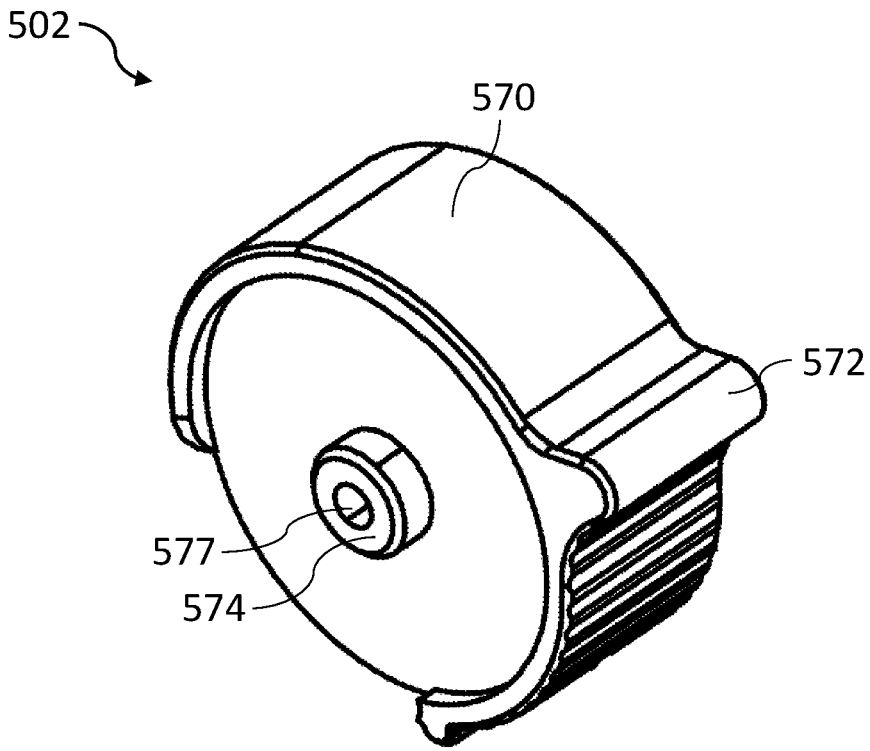
FIG. 5A is a perspective view of a thumbwheel interface for use with the controller of FIG. 3.
Figure 5B:
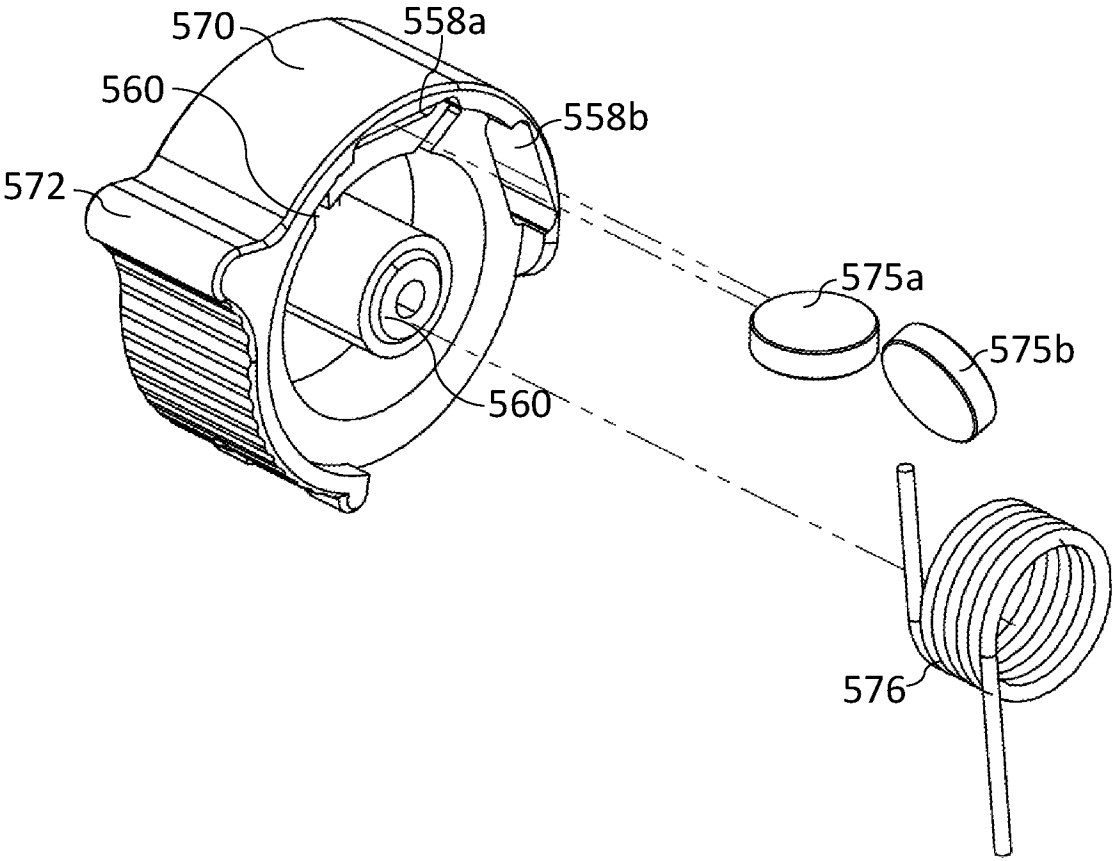
FIG. 5B is an exploded view of the thumbwheel interface of FIG. 5A.

With respect to FIGS. 5A-5B, the thumbwheel interface 502 includes an outer body 570 and a support rod 574 about which the outer body 570 is able to rotate. The support rod 574 defines an axis about which the outer body 570 rotates. The support rod 574 may include opening 577 that may be used to secure the thumbwheel interface 502 to the cartridge 518. The outer body 570 may include magnets 575 installed in pockets 558. The sensor 501 of the remote controller 500 may detect the magnetic flux of the magnets 575 to determine the orientation of the outer body 570 as discussed in detail above. The outer body 570 includes a protrusion 572 extending radially from the annular body 570. The protrusion 572 of the outer body 570 may be moved about the support rod 574 between a first position or "resting" position (see FIG. 6C) to a second position or "full throttle" position (see FIG. 6D). The thumbwheel 502 may include a biasing member such as a torsion spring 576 installed around the support rod 574 and engaged in a slot 560 in the outer body 570 to bias the protrusion 572 of the thumbwheel interface 502 toward the first position. A user holding the handle 510 of the housing 508 with their hand may use their thumb to move the protrusion 572 forward and/or rearward to adjust the position of the protrusion 572, for example, move the protrusion 572 from the first position toward the second position. Moving the protrusion 572 rotates the outer body 600 which moves the magnets 575 of the thumbwheel interface 502. The sensor 501 of the remote controller 500 may detect the position of the magnets 575 to determine the position of the thumbwheel interface 502 and output corresponding throttle control signal as discussed below.

With respect to FIGS. 6A-6D, the remote controller 500 is provided with the thumbwheel interface 502. As illustrated, the thumbwheel interface 502 is inserted into the cartridge 518 and the cartridge 518 is inserted into the through hole 514 of the housing 508. The thumbwheel interface 502 may be inserted into the cavity 534 of the cartridge 518 with the support rod 574 secured to the cartridge 518 via the holes 536, 538 to inhibit the support rod 574 from moving substantially relative to the cartridge 518. In forms where the ends of the support rod 574 are protrusions that are received into recesses of the cartridge 518, the protrusions may have a cross-sectional shape (e.g., square) that engages with the walls forming the recesses of the cartridge that inhibits the support rod 574 from rotating relative to the cartridge 518.

The cartridge 518 is inserted into the through hole 514 with the lower portion 524 of the cartridge 518 extending into the narrowed portion of the through hole at the lower side of the housing 508 until the step 546 of the cartridge 518 rests on a ledge 580 of the housing 508 in the through hole 514. The step 546 of the cartridge 518 includes an opening 554 (see FIGS. 6C-6D) that may be aligned with a mounting hole 556 of a ledge 580 of the housing 508. A fastener (e.g., a screw) may be extended through the opening 554 of the cartridge 518 and into the mounting hole 556 of the housing 508 to secure the cartridge 518 to the housing 508. The outer body 570 of the thumbwheel interface 502 may include a flat side 582 that enables access to the opening 554 and mounting hole 556 of the housing 508 to secure the cartridge 518 to or remove the cartridge 518 from the housing 508 with the fastener when the outer body 570 is rotated to the second position (see FIG. 6D).

The cartridge 518 may be removably attached to the housing 508 by a single fastener to permit the cartridge 518 to be quickly removed and/or replaced. For example, if the thumbwheel interface 502 becomes damaged or debris enters the cavity 534 or the thumbwheel interface 502, the thumbwheel interface 502 may quickly be replaced by removing the fastener to detach the cartridge 518 from the housing 508 and removing the thumbwheel interface 502 from the cartridge 518 by detaching the support rod 574 from the cartridge 518. The cartridge 518 and/or thumbwheel interface 502 may be removed to replace the thumbwheel interface 502 with another thumbwheel interface 502 or another type of throttle control interface. To remove the thumbwheel interface 502 from the remote controller 500, the outer body 570 is rotated toward the second position (see FIG. 6D) until the flat side 582 of the outer body 570 creates a channel between the outer body 570 and the rear wall of the cartridge 518 that provides access to the fastener extending through the opening 554 of the cartridge 518. A tool (e.g., a screwdriver) may then be extended into the channel to remove the fastener. The cartridge 518 may then be withdrawn from the through hole 514 of the housing. The cartridge 518 and/or thumbwheel interface 502 are able to be attached and detached from the remainder of the remote controller 500 without opening the housing 508 or removing the watertight seal. Thus, the throttle interface controller is able to be removed and/or replaced without exposing the components within the housing 508 of the remote controller 500 to water and/or debris.

The housing 508 of the remote controller 500 includes an upper portion 404 and a lower portion 406 that are joined together to form a watertight cavity within the housing 508. The handle 510 is an elongate portion of the housing 508 defining a longitudinal axis of the remote controller 500 that the user may grasp with their hand such that their thumb is positioned proximate the throttle control interface assembly 516 which includes the thumbwheel interface 502 in this embodiment. The user may then move or rotate the thumbwheel interface 502 with their thumb while gripping the handle 510. The display portion 512 extends from the handle 510 at an angle (e.g., an obtuse angle) and includes the user interface 426.

The user interface 426 includes the display portion 512 which may include a display screen 428 for displaying a graphical user interface (GUI) and input buttons 430 that a user may press to make selections and navigate through the screens displayed on the display screen 428. The display screen 428 is bonded to a clear overlay 429 that protects the display screen 428 from damage while permitting a user to view the display screen 428 through the clear overlay 429. The display screen 428 may be bonded to the clear overlay 429 such that no air or fluid is able to get in between the display screen 428 and the clear overlay 429 which aids to ensure the display screen 428 does not fog up or otherwise have condensation build up below the overlay 429 that would obscure the display screen 428. The clear overlay 429 may be made of a polycarbonate or tempered glass material as examples. The user interface 426 may also include a speaker for providing information and alerts audibly to the user. The user interface 426 may also include a microphone for receiving voice commands from the user. For instance, the rider may speak a command to move forward, turn to the left, turn to the right, increase or decrease the ride height, accelerate, decelerate, stop, and/or travel at a certain speed.

Figure 7:
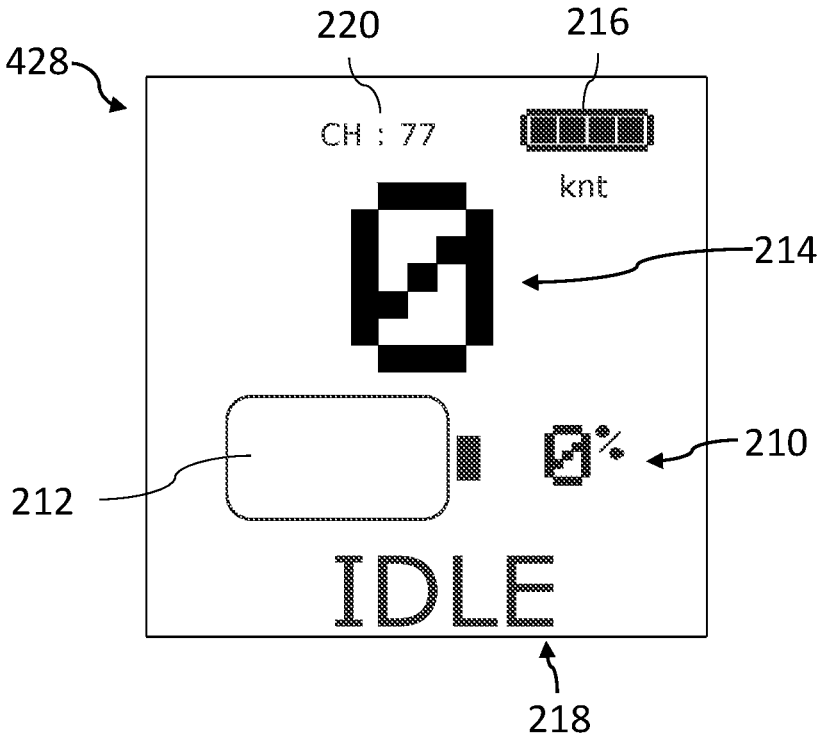
FIG. 7 is an example display of the wireless controller of FIG. 3.

With reference to FIG. 7, an example display of the display screen 428 is shown. The display screen 428 may indicate a battery charge percentage 210 of the watercraft 100, a battery charge level graphic 212 of the watercraft 100, the speed 214 of the watercraft 100, the battery charge level 216 of the wireless remote 500, the ride mode 218 of the watercraft 100 (discussed below), and the communication channel 220 the wireless controller is operating on. The user may navigate through the menu to change various settings of the watercraft 100 including the ride mode, adjust an operating parameter of the watercraft 100 (e.g., adjust the deceleration or speed limit), etc.

The wireless remote controller 500 may include a plurality of profiles or ride modes that are selected to control the operation of the watercraft 100. For instance, a new user may start at a beginner level where the watercraft is limited to lower speed and rates of acceleration. After a period of time, the user may progress through an intermediate, advanced, and expert levels unlocking increasingly more power, higher speeds, rates of acceleration. Additional features may also be unlocked including a wave-riding mode and a reverse mode. In some forms, the watercraft may assist the rider (e.g., provide stability to the board 102 via movable control surfaces) in the lower levels and progressively provide less and less assistance as the user gains more experience.

In some embodiments, the rider's usage and performance data is collected by the watercraft (e.g., the IPU) and/or wireless controller 500. The rider's usage and performance data (e.g., time of use, number of falls, etc.) may be uploaded to a cloud for storage and analysis. A determination of the appropriate ride mode for the rider may be determined based on the rider analysis. The rider may have a profile associated with a smartphone application that enables the user to transfer their rider profile information between different watercraft 100 so that the unlocked ride modes and features are available to that rider on other watercraft 100. The rider profile may include biometric information of the rider including their height, weight, image of their face for facial recognition of a user to authenticate the user, login information, ride style data, and ride height data. The watercraft 100, remote controller 500, and/or cloud may be used to automatically identify and track riders based on their unique rider characteristics.

In the embodiment shown, the remote controller 500 includes an idle mode, lock mode, easy mode, intermediate mode, and advanced mode. In the idle mode, the throttle cannot be applied. This is the default mode of the remote controller 500 on startup. The remote controller 500 may also revert to this mode from any normal ride mode as a failsafe if the user does not provide throttle input after 30 seconds. In the lock mode, the throttle also cannot be applied, to reduce the possibility that accidental throttle inputs would undesirably operate the propeller.

The easy mode is for new riders. The easy mode may limit acceleration performance, available power to approximately 60 percent, and top speed to approximately 12 knots or 14 mph. The intermediate mode is for riders proficient in falling. The intermediate mode has higher acceleration performance, limits power to approximately 70 percent, and top speed to approximately 16 knots or 18 mph. The advanced mode is for experienced riders. The advanced mode provides unrestricted acceleration performance and has no limits on power, producing a top speed in excess of 20 knots or 23 mph.

Figure 6A:
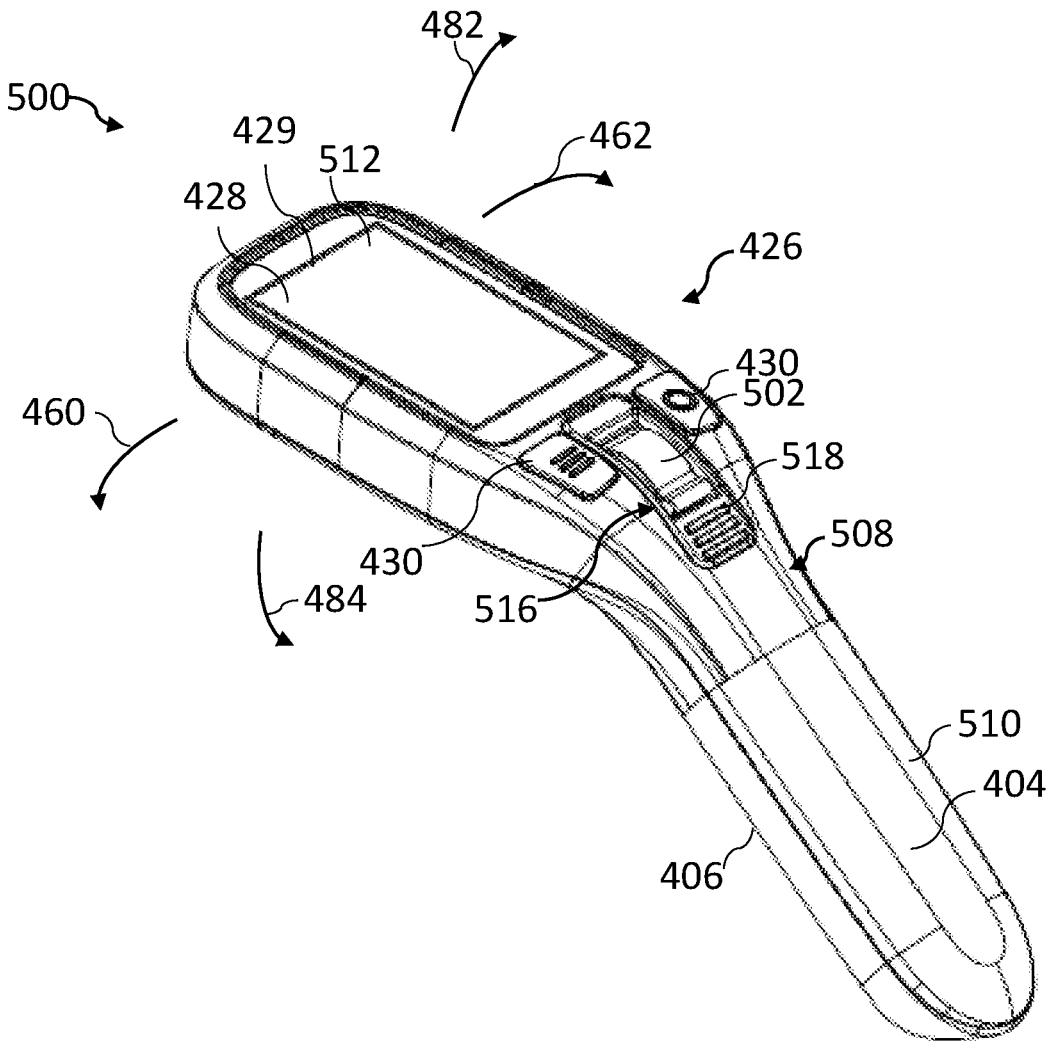
FIG. 6A is a perspective view of the controller of FIG. 3 including the thumbwheel throttle interface of FIG. 5.
Figure 6B:
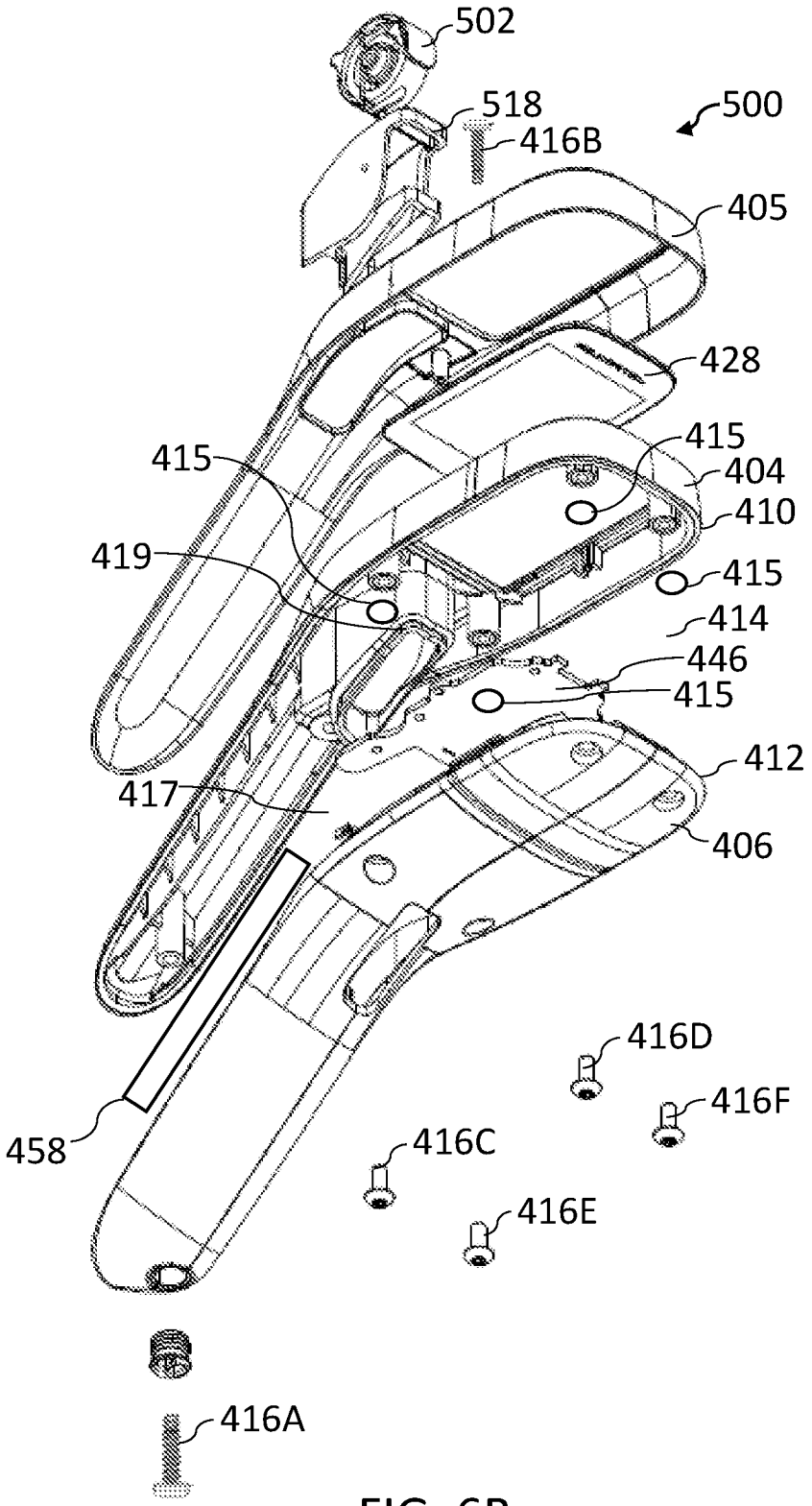
FIG. 6B is an exploded, perspective view of the wireless controller of FIG. 6A.

The upper portion 404 and the lower portion of the housing 508 are assembled using a series of screws 416A-F (see FIG. 6B). In the embodiment of FIGS. 6A-6D, cartridge 518 is affixed to the upper portion 404 using a fastener such as screw 432.

The remote controller 500 may include a circuit board 446 that is rigidly mounted to the upper portion, e.g., using screws, such that it is in contact with the housing 402 of the remote controller 500 to better conduct vibrations to the IMU 454 (e.g., for fall detection). The circuit board 446 may further include a vibration motor for providing haptic feedback to the user through the remote controller. The remote controller 500 may also include a pressure sensor that monitors the pressure within the sealed cavity 408 and/or the pressure about the remote controller 500, for example, for detecting when the remote controller 500 is under water. In some forms, the pressure sensor is within the sealed cavity 408 and monitors the change in pressure within the sealed cavity 408 caused by compression of the housing 508 from being under water or caused by a user gripping the remote controller 500. In some forms, the pressure sensor is positioned on the outside of the housing 402 or exposed to the outside of the housing 402 for sensing the ambient pressure. As one example, the housing of the remote controller 500 may include a through hole extending through the housing 508 to the pressure sensor mounted within the housing 508. If the remote controller 500 detects it is under water, the remote controller 500 may cease communicating throttle control signals or may communicate the throttle control signals along with an error flag.

A seal 414 (e.g., an O-ring) is positioned between a peripheral edge 410 of the upper portion 404 and a peripheral edge 412 of the lower portion 406 to seal the interface between the upper and lower portions 404, 406 and inhibit water and debris from entering the housing 508 when the upper and lower portions 404, 406 are joined together. A seal 417 (e.g., an O-ring) is positioned between an inner edge 419 of the upper portion 404 and an inner edge 421 of the lower portion 406 of the housing 508 defining the through hole 514 to seal the interface between the upper and lower portions 404, 406 and inhibit water and debris from entering the housing 508 when the upper and lower portions 404, 406 are joined together. O-rings 415 may be used to seal bosses that receive screws 416C-416E. Moreover, the seals 414, 417 trap air within the cavity of the remote controller 500 and prevent the air from escaping the remote controller 500, for example, when the remote is under water. The cavity 408 of the remote controller 500 is sized such that the volume of the cavity 408 that is not occupied by components of the remote controller 500 is sufficiently large such that the remote controller 500 is buoyant in fresh and salt water due to the volume of air within the housing 508. The peripheral edge 410 of the upper portion and/or the peripheral edge 412 of the lower portion 406 include a groove for receiving the seal 414 therein. The inner edge 419 of the upper portion 404 and inner edge 421 of the lower portion 406 may include a groove for receiving seal 417 therein. Fasteners 416C-F may be extended into the upper and lower portions 404, 406 to secure the upper portion 404 to the lower portion 406 and to draw the upper portion 404 toward the lower portion 406 to clamp the seals 414, 417 therebetween. The upper and lower portions 404, 406 may be formed of a rigid, plastic material. The upper portion 404 and/or the lower portion 406 may include a rubber overlay or a rubber layer 405 (or hydrophobic material) disposed over the plastic layer on the outer surface of the housing 508. The plastic layer of the upper portion 404 may include openings through which a user may access and press buttons 430 by pressing on the rubber overlay extending over the openings in the plastic layer.

The electronic components of the remote controller 500 are powered by the battery 458. The battery 458 is disposed within the cavity of the housing 508. The battery 458 is preferably positioned within the handle 510 of the remote controller 500 (see FIGS. 6C-6D). By placing the battery 458 in the handle of the remote controller 500, a substantial portion of the weight of the remote controller 500, for example, more than half of the weight of the remote controller 500, is positioned within the portion of the remote controller 500 held by the user. Reducing the weight of the remote controller 500 that is distal from the user's hand may make the remote controller 500 feel more balanced within the user's hand and easier to hold onto for long periods of time. For example, the torque on the user's hand due to the weight of the remote controller 500 in the display portion 512 is reduced, which may reduce the fatigue a user experiences when holding the remote controller 500. The remote controller 500 may include a charging coil within the cavity 408 enabling the battery 458 to be charged wirelessly similar to the embodiments of U.S. Patent Application Publication No. 2022/0063786. Because the remote controller 500 may be wirelessly charged, the remote controller 500 does not need a charging port or cables that extend through the housing 508 and into the sealed cavity 408. This eliminates another opening through which water and debris could potentially enter the housing 402.

The thumbwheel interface 502 installs into the cartridge 518 which installs in the through hole 514 in the housing 508. With reference to FIG. 5B, the thumbwheel interface 502 further includes magnets 575 that interact with a Hall effect sensor 501 mounted on the circuit board 446 within the cavity of the housing 508. The magnets 575 are mounted or positioned in cavities or pockets 558 at the outer edge of the thumbwheel interface 502 such that the magnets 575 are positioned proximate the wall of the through hole 514 of the housing 508. The first magnet 575*a* may be mounted approximately perpendicular to the second magnet 575*b*. The first magnet 575*a* is spaced apart about the thumbwheel interface 502 from the second magnet 575*b* about a quarter of the way around the thumbwheel interface 502 such that the first magnet 575*a* is proximate the Hall effect sensor in the resting position and the second magnet 575*b* is proximate the Hall effect sensor 501 in the full throttle position. In some forms, the magnetic pole of the first magnet 575*a* facing radially outward of the thumbwheel interface 502 is opposite of the magnetic pole of the second magnet 575*b* that is facing radially outward of the thumbwheel interface 502. For example, the north pole of the first magnet 575*a* faces radially outward and the north pole of the second magnet 575*b* faces radially inward or vice versa. This creates a greater change in the magnitude and direction of the magnetic flux as the thumbwheel interface 502 is rotated between the resting position and full throttle position which may aid in determining the orientation of the thumbwheel interface 502. In another form, the magnetic pole of the first magnet facing radially outward of the thumbwheel interface 502 is the same as the magnetic pole of the second magnet that is facing radially outward of the thumbwheel interface 502. In still other forms, a single magnet may be used.

Figure 6C:
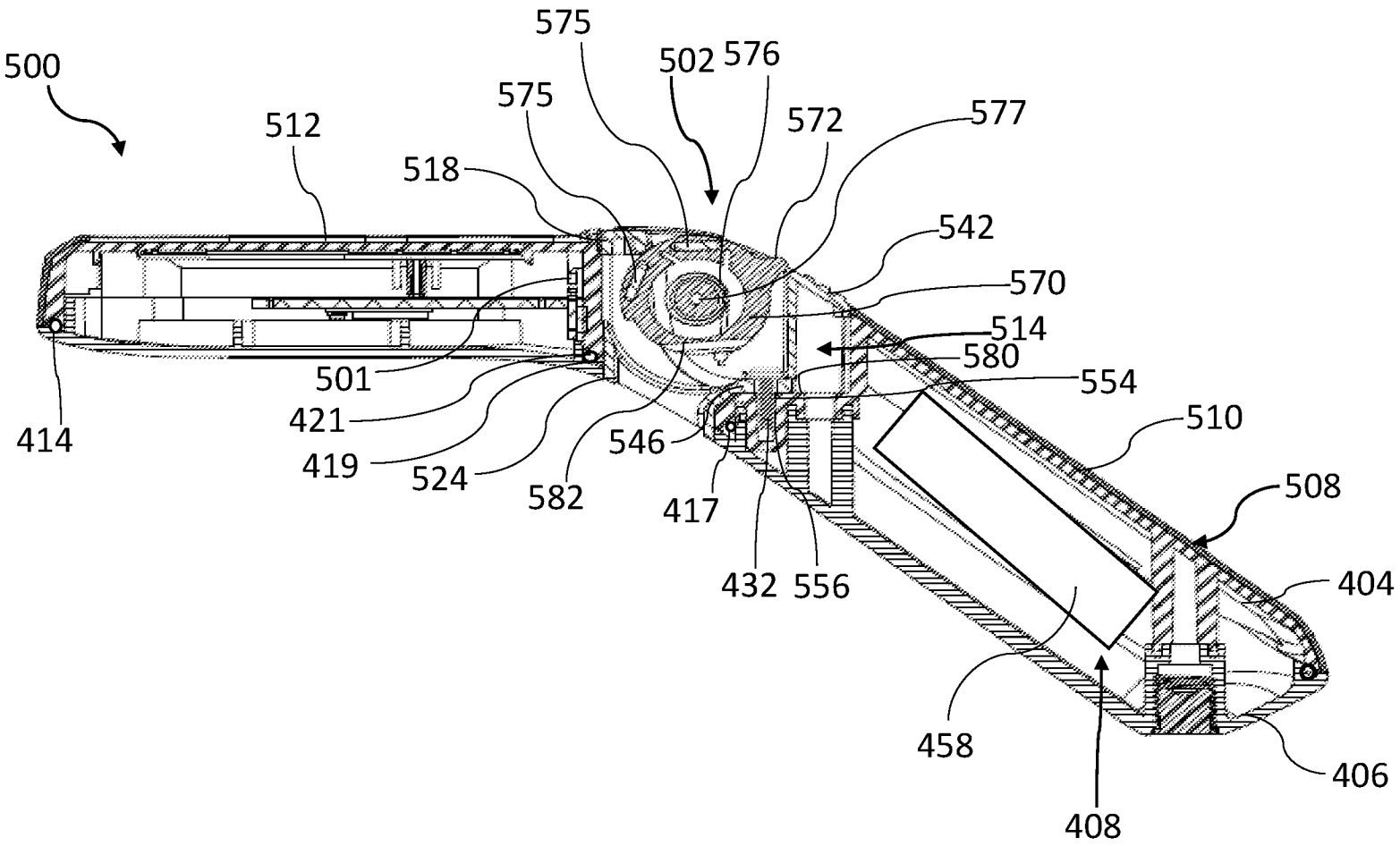
FIG. 6C is a cross-sectional view of the controller of FIG. 6A with the thumbwheel interface in a first position.
Figure 6D:
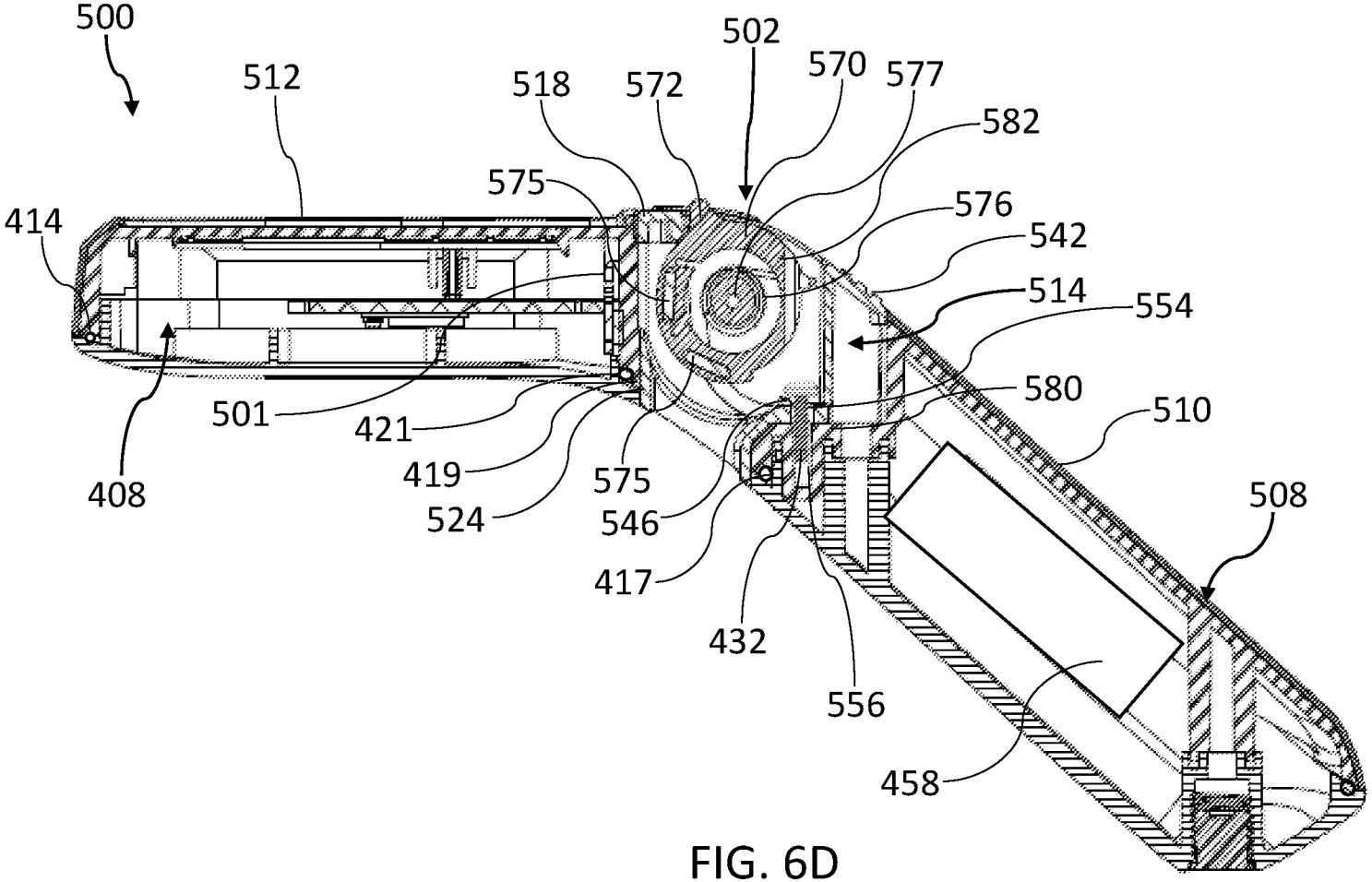
FIG. 6D is a cross-sectional view of the controller of FIG. 6A with the thumbwheel interface in a second position.

The thumbwheel interface 502 includes the spring 576 that biases the thumbwheel interface 502 away from a "full throttle" position with the protrusion 572 at a forward position as shown in FIG. 6D toward a "resting" or "off" position with the protrusion 572 at a rearward position as shown in FIG. 6C. The user may rotate the thumbwheel interface 502 by applying a force to overcome the biasing force of the spring 576 to move the thumbwheel interface 502 from the resting position. When the user releases the thumbwheel interface 502 (or applies a force less than that of the spring 576), the spring 576 rotates the thumbwheel interface 502 back toward the resting position. The spring 576 may be housed within the thumbwheel interface 502 such that it is protected from the elements (see FIG. 5B).

The Hall effect sensor 501 may be positioned proximate the wall of the through hole 514 to detect the magnetic flux of the magnets 575. As the thumbwheel interface 502 is rotated between the resting and full throttle positions, the orientation of thumbwheel interface 502 and the orientation of the magnets 575 relative to the Hall effect sensor 501 changes. The change in orientation of the magnets 575 changes the magnetic flux detected by the Hall effect sensor 501. The Hall effect sensor 501 may be a three-dimensional Hall effect sensor or magnetometer configured to detect the magnetic flux in three directions. The change in magnetic flux is processed via a processor 448 using algorithms and programs stored in memory 450 to determine the orientation of the thumbwheel interface 502 and to generate a throttle control output to send to the watercraft 100 via the communication circuitry 452. For instance, when the thumbwheel interface 502 is in the resting position the processor 448 may determine the thumbwheel interface 502 is rotated 0 degrees and send a signal to the watercraft 100 that no throttle input is received. When the thumbwheel interface 502 is in the full throttle position, the processor 448 may determine the thumbwheel is rotated 80 degrees and send a signal to the watercraft indicating that a high throttle input has been received from the user. The processing of the magnetic flux detected by the Hall effect sensor 501 is described in further detail below.

The Hall effect sensor 501 is configured to detect the magnetic flux of the magnets 575 of the thumbwheel interface 502. The processor 448 receives the magnetic flux data generated by the Hall effect sensor 501. The processor 448 may be configured to process the magnetic flux data to determine the orientation of the thumbwheel interface 502 and to generate a throttle value to send to the watercraft 100. As described above, the Hall effect sensor 501 is positioned within the cavity of the housing 508 near the through hole 514 in which the thumbwheel interface 502 is positioned. The Hall effect sensor 501 may be a two-axis or a three-axis Hall effect sensor that is configured to detect the magnitude of the magnetic flux in two or three directions. For example, the Hall effect sensor 501 may detect the strength of the magnetic flux in the X-axis, Y-axis, and/or Z-axis. The processor 448 may determine the angle of the magnetic flux of the magnets at the Hall effect sensor 501 to determine the physical orientation or angular position (e.g., 0-80 degree rotation in the embodiment shown) of the thumbwheel interface 502 relative to the housing 402. The processor 448 may be configured to determine the angle of the magnetic flux based on the magnitude of the flux in two or three dimensions. Where the thumbwheel interface 502 rotates about an axis that is parallel to the Y-axis, the thumbwheel interface 502 rotates primarily in the XZ plane. The magnets are also aligned in the XZ plane and rotate primarily within the XZ plane as the thumbwheel interface 502 rotates. The processor 448 may thus determine the angular position of the thumbwheel interface 502 by detecting the angle of the magnetic flux in the XZ plane. Where the polarity of the magnets facing radially outward of the thumbwheel interface 502 are opposite one another, rotating the thumbwheel about 90 degrees (the range of motion of the thumbwheel in the embodiment shown) results in a change in angle of the magnetic flux of about 180 degrees. For example, where the south pole of the first magnet faces radially outward and the north pole of the second magnet faces radially outward, by rotating the thumbwheel from the resting position to the full throttle position, the direction of the magnetic flux at the Hall effect sensor 501 is reversed due to the polarity change of the magnet proximate the Hall effect sensor 501. The angle of the magnetic flux in the XZ plane may be calculated using the function a tan 2(X, Z) as will be described in further detail below.

In the embodiment shown, the thumbwheel interface 502 includes a flat side 436 (see FIG. 6C) that enables access to the screw 432 (e.g., screw) that secures the thumbwheel to the cartridge 518. The thumbwheel interface 502 may be removably attached to the cartridge 518 by a single screw 432 to permit the thumbwheel interface 502 to be quickly removed and/or replaced. For example, if the thumbwheel interface 502 becomes damaged or debris enters the through hole 514 or the thumbwheel interface 502, the thumbwheel may quickly be replaced by removing the screw 432 to detach the thumbwheel interface 502 from the cartridge 518. To remove the thumbwheel interface 502 from the cartridge 518, the thumbwheel interface 502 is rotated toward a "full throttle" position (see FIG. 6D) until the flat side 436 of the thumbwheel interface 502 creates a channel between the thumbwheel interface 502 and the wall of the cartridge 518 to provide access to the screw 432. A tool (e.g., a screwdriver) may then be extended into the channel to remove the screw 432. The thumbwheel interface 502 may then be withdrawn from the cartridge 518. When the thumbwheel interface 502 is removed, the cartridge 518 may be cleaned of any debris therein. The thumbwheel interface 502 or a replacement throttle control interface may be inserted into the cartridge 518 and secured to the cartridge 518 by the screw 432 upon rotating the thumbwheel interface toward the full throttle position to create the access channel between the thumbwheel interface and the wall forming the recess 422. The user may then use the thumbwheel to provide a throttle input to their watercraft or other motor driven device. The thumbwheel interface 502 is able to be attached and detached from the remainder of the remote controller 500 without opening the housing 402 or removing the seal 414. Thus, the thumbwheel interface 502 is able to be removed and/or replaced without exposing the components within the cavity 408 of the remote controller 500 to water and/or debris.

Figure 8:
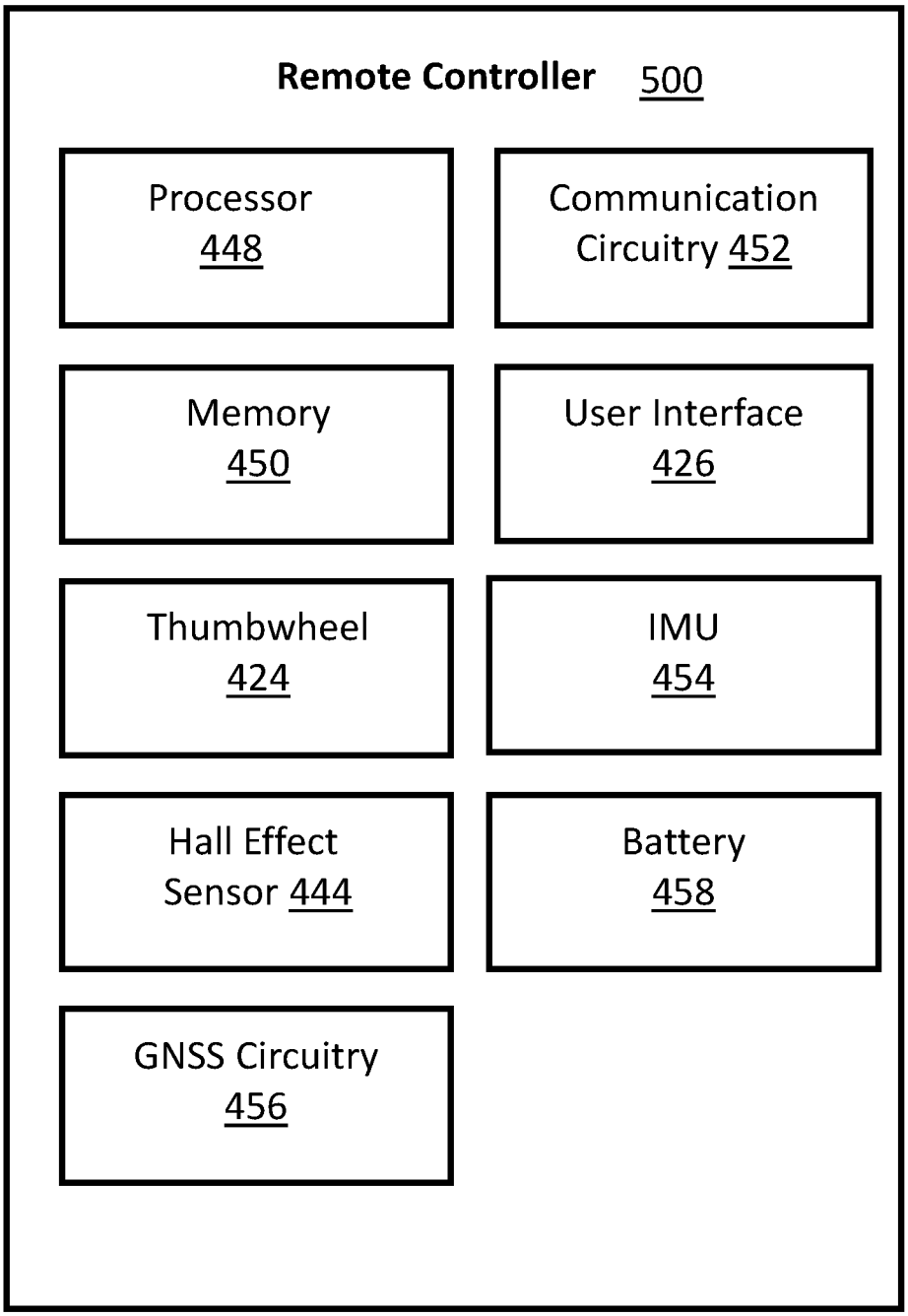
FIG. 8 is a block diagram of the wireless controller of FIG. 3.

With respect to FIG. 8, the remote controller 500 includes a processor 448 that is communicatively coupled to the memory 450, the communication circuitry 452, the user interface 426, the Hall effect sensor 501, the inertial measurement unit (IMU) 454, the GNSS circuitry 456, and the battery 458. The processor 448, memory 450, communication circuitry 452, the Hall effect sensor 501, the IMU 454, and the GNSS circuitry 456 may be mounted to the circuit board 446 within the cavity 408 of the housing 508.

The memory 450 stores programs, settings, and data accessible by the processor 448 to provide functionality to the remote controller 500 including communicating with remote devices, presenting information to the user, receiving user input, and processing data received from the sensors of the remote controller 500. The processor 448 is in communication with the user interface 426 and the sensor 501 and configured to receive input from the rider as described herein. The processor 448 is operatively coupled to the communication circuitry 452 such that the processor 448 is able to communicate with remote devices via the communication circuitry 452. The communication circuitry 452 is configured to communicate via one or more wireless protocols such as Bluetooth, cellular, Wi-Fi, Zigbee and the like. The communication circuitry 452 enables the remote control to communicate with a computer of the watercraft. For example, the processor 448 of the remote controller 500 is able to communicate throttle control signals to the watercraft 100 via the communication circuitry 452 to operate the watercraft. The processor 448 may communicate other information to the watercraft and receive other information and data from the watercraft 100 via the communication circuitry 452. For example, the remote controller 500 may receive watercraft battery charge information, error messages, user rider profile information, location information, and speed information from the watercraft 100. The processor 448 of the remote controller 500 may receive this information and store it in memory 450 and/or display it to the user via the user interface. The remote controller 500 may similarly send information to the watercraft 100 such as throttle input data, remote controller battery 458 charge information, location data (e.g., determined using the GNSS circuitry 456), speed data and the like.

The processor 448 may determine the location of the remote controller 500 via the signals received by the GNSS circuitry 456. The processor 448 may further monitor the determined location of the remote controller 500 over time to determine the speed of the remote controller 500 and/or track the path the user takes with the watercraft (e.g., to determine a total distance traveled in a trip). The processor 448 may communicate the determined location of the remote controller 500 to the watercraft 100 for a comparison of the location between the remote controller 500 and the watercraft 100. If the distance between the watercraft 100 and the remote controller 500 exceeds a predetermined distance, the watercraft 100 may determine the user is not on the watercraft 100 (or perhaps has dropped or lost the controller 500) and may cease responding to control signals from the remote controller 500. In some embodiments, the watercraft 100 may be configured to autonomously travel toward the location of the remote controller 500 (e.g., upon input from the user at the remote controller 500 or the watercraft 100) when the remote controller 500 is more than a predetermined distance away from the user. This reduces the distance a user may have to swim to get back to the watercraft 100 where the user falls off the watercraft 100 and, for example, the watercraft 100 is being swept away by waves and/or a current. The watercraft 100 may similarly determine that a user is no longer on the watercraft 100 when the watercraft 100 is no longer in communication with the remote controller 500 or the signal strength of the wireless connection between the watercraft 100 and the remote controller 500 falls below a threshold (e.g., because the remote controller 500 is too far away from the watercraft 100). The remote controller 500 may be used similarly to a magleash in that once the signal strength between the remote controller and watercraft is too low, is lost, or indicates the remote controller is more than a predetermined distance from the watercraft 100, the watercraft 100 determines the user has fallen off the watercraft 100 or is no longer on the watercraft 100 and no longer responds to throttle control signals of the remote controller 500. In some forms, the watercraft 100 is configured such that the signals communicated by the watercraft 100 are directed upward from the deck of the watercraft 100 where the user is when riding the watercraft 100. The watercraft 100 may include a cavity 113 with walls formed of conductive material (e.g., carbon fiber) or other material that inhibits RF signals from traveling into or out of the cavity 113 from the sides and below the watercraft 100. Thus, the watercraft 100 may be configured to lose communication with the remote controller 500 when the remote controller 500 is not above the deck 108 of the watercraft 100.

The processor 448 may be configured to distinguish magnetic flux of the magnets 575 of the thumbwheel interface 502 from magnetic interference caused by an external magnet or signal. In other words, the processor 448 may be configured to identify the magnetic interference and reject throttle control signals determined to be caused by an external magnet or source other than the thumbwheel. For example, the watercraft 100 may include magnets or otherwise emit magnetic flux. The Hall effect sensor 501 may detect the magnetic flux from the watercraft when the remote controller 500 is brought into proximity with the watercraft 100. The processor 448 may identify the magnetic flux is caused by a magnet other than those of the thumbwheel interface 502 and reject the input as noise. Identifying magnetic flux from external sources as noise is advantageous because the remote controller 500 will not cause the watercraft to operate in response to these signals from external magnets. As described in further detail below, the magnetic interference is able to be identified in part by evaluating the magnitude of the magnetic flux and the angle of the magnetic flux in multiple dimensions. Those having skill in the art will appreciate that while the remote controller 500 is disclosed as being used in the context of controlling a watercraft 100, the remote controller 500 may be adapted for uses with other motorized devices including electric jetboards, boats, trolling motors, electric skateboards, electric longboards, RC cars, drones. Moreover, while the remote controller 500 shown includes two magnets 575, in other embodiments, the remote controller 500 may include a single magnet or three, four, or more magnets.

The processor 448 may identify and filter out noise to determine the throttle input from the thumbwheel interface 502 using the methods and techniques disclosed in U.S. Pat. App. Publ. 2022/0063786. As mentioned above, the processor 448 calculates the angle of the magnetic flux to determine the throttle input or orientation of the thumbwheel interface 502 rather than relying solely on a magnitude of the magnetic flux in one direction. Using the angle of the magnetic flux rather than the magnitude in a single dimension is advantageous because magnetic interference may more easily be identified. For instance, the processor 448 may identify an expected range of flux angles from known, valid throttle inputs from the thumbwheel interface 502 as it is rotated. An external magnet is less likely to produce the requisite flux angle at the Hall effect sensor 501 than to simply produce a magnitude in a single direction. Moreover, because the angle of the flux from valid inputs progressively increase or decrease as the thumbwheel is rotated (e.g., moving the thumbwheel from 0 degrees to 90 degrees causes the flux angles to change progressively from 0 degrees to 180 degrees), by monitoring the angle of the magnetic flux over time, the processor 448 is able to determine whether the flux angles leading up to the currently measured flux angles are consistent with those generated by the thumbwheel interface 502. For instance, if a flux angle of 170 degrees is currently measured, but the previously measured flux angles are not, for example, 140, then 150, then 160, the processor 448 may determine the flux is generated by an external magnet and not the thumbwheel, and thus is not a valid throttle input. Alternatively or additionally, if the rate of change in the flux angle exceeds a predetermined limit, the processor 448 may determine the calculated angle is not a valid throttle input. Those having skill in the art will appreciate that measuring the angle of the flux generated by one or more magnets mounted to a trigger or other throttle control mechanism throughout its range of motion could similarly use the above approach to identify and filter out magnetic interference.

In another approach to distinguish magnetic interference from a valid throttle input of the thumbwheel interface 502, the processor 448 may compare the magnetic flux detected by the Hall effect sensor 501 with stored data known to be associated with valid throttle inputs. For example, the memory 450 may include magnetic flux data captured by the Hall effect sensor 501 as the thumbwheel is moved through its full range of motion. The processor 448 may compare data captured by the Hall effect sensor 501 with the data of known valid throttle inputs, for example, evaluating the magnitude of the flux, the angle of the flux relative to the Hall effect sensor, and the magnitude of the flux at the detected angle.

The processor 448 may evaluate the magnitude of the flux in the X-axis, Y-axis, and/or Z-axis to determine if the detected flux falls within a range of magnitudes expected from the magnets of the thumbwheel interface 502. In the example embodiment of the thumbwheel interface 502 provided in FIG. 3, the thumbwheel interface 502 may be rotated from the resting position to the full throttle position, which is approximately from 0-80 degrees, however, in other embodiments the thumbwheel may have a greater or smaller range of motion. In a preferred embodiment, the Hall effect sensor 501 is model number MLX90363 manufactured by Melexis of Ypres, Belgium. This device outputs flux magnitude values using an 8-bit (i.e., 0-255) or 12-bit (i.e., 0-4095) value. In one example, the data known to be caused by the thumbwheel interface 502 being rotated indicates that a valid throttle input (e.g., one that is actually caused by rotation of the thumbwheel interface 502) will have a magnitude in the X-axis in the range of about −1000 to about 2500 (the magnitude values referenced herein are values output by the sensor 501, e.g., from −16,383 to 16,383), a magnitude in the Y-axis in the range of about −1200 to about 200, and a magnitude in the Z-axis of about −2000 to about 2500. Thus, the processor 448 may determine that any input received at the Hall effect sensor 501 that is outside of the ranges of expected values (e.g., by more than a predetermined percent, such as 10%) is likely to be caused by magnetic interference or an external magnet and should be rejected.

The processor 448 may further evaluate whether an input is valid, even if it falls within the expected ranges noted above, by evaluating whether the magnitude of the flux in one dimension corresponds with the expected magnitude of the flux in another dimension. For example, when the flux in the Z-axis is 1000, the processor 448 may determine that a flux in the Z-axis corresponds with an angular position of the thumbwheel of 20 degrees. At an angular position of 20 degrees, the thumbwheel interface 502 expects a flux magnitude in the Y-axis of about −600 and a flux magnitude in the X-axis of about 2100. The processor 448 may determine if the flux magnitude in two or three dimensions sufficiently corresponds with the flux magnitudes that are expected from a valid throttle input (e.g., +/−10%). Continuing the example above, if the measured flux magnitude was 200 in the Y-Axis and −200 in the X-axis, the processor 448 may determine that the flux value does not sufficiently correspond with the expected values and reject the input as caused by magnetic interference.

The processor 448 may be configured to compute the angle of the flux in the XZ plane. The processor 448 may compute the angle by using the arc-tangent function to calculate an angle from the measured flux in the X-direction and the measured flux in the Z-direction. For example, the known A TAN 2 function can be used to calculate an angle in degrees from magnitudes of flux in the X and Z directions, i.e., a tan 2(X,Z). The memory 450 may store a data structure (e.g., a graph) associating output of the a tan 2(X,Z) calculation to the mechanical angle or angular position of the thumbwheel interface 502. For the remote controller 500, the angle of the flux in the XZ plane corresponds directly to the how far the thumbwheel interface 502 has been rotated. By calculating a tan 2(X,Z), the angle the thumbwheel interface 502 has been rotated may be determined by comparing the a tan 2(X,Z) value with a graph or table indicating the corresponding mechanical angle of the thumbwheel for that a tan 2(X,Z) value.

Similarly, the processor 448 may compute the angle of the flux in the XY plane, for example. Memory 450 may store a data structure (e.g., a graph) associating the output of the a tan 2(X,Y) calculation the mechanical angle or angular position of the thumbwheel interface 502. For the remote controller 500, the magnitude of flux in the Y-direction will depend up on how well-aligned the magnets 575 are, relative to the 3D Hall effect sensor 501. Thus, the angle of the flux in the XY plane may not correspond as directly to how far the thumbwheel interface 502 has been rotated.

As another approach for evaluating whether the input received from the Hall effect sensor is valid, the processor can be used to compare the XZ flux angle to the XY flux angle. The processor 448 may be configured to compare whether the measured flux angle in the XZ plane corresponds to the expected measured flux angle in the XY plane.

Or, in other words, whether the calculated a tan 2(X,Z) value and the a tan 2(X,Y) value both correspond with approximately the same mechanical angle or angular position of the thumbwheel interface 502. For example, the processor 448 may calculate that the a tan 2(X,Z) and determine that the output of the a tan 2(X,Z) corresponds to a mechanical angle of the thumbwheel interface 502 of about 40 degrees. The processor 448 may then determine if the calculated a tan 2(X,Y) value also corresponds to a thumbwheel mechanical angle of 40 degrees. If the a tan 2(X,Y) value also indicates the thumbwheel mechanical angle is 40 degrees (within an acceptable margin of error), the processor 448 may determine the input is valid. If, however, the a tan 2(X,Y) value indicates the thumbwheel mechanical angle is not 40 degrees the processor 448 may determine the input is caused by noise and reject the input. As another example, if the a tan 2(X,Z) value indicates the thumbwheel is rotated 80 degrees, but the a tan 2(X,Y) value indicates the thumbwheel is rotated 30 degrees, the processor 448 may determine the input is caused by an external magnet or noise and reject the input.

The processor 448 may determine whether detected flux has an angle in both the XZ plane and XY plane that corresponds to angles of flux in the XZ and XY planes of known valid inputs (e.g., data of known valid inputs stored in memory 450). Input may be determined to be noise or caused by an external magnet if it does not sufficiently correspond with the values expected for a valid input based on the stored data of known valid inputs.

Once the input received by the Hall effect sensor 501 is determined to be a valid input, (e.g., using the methods described herein), the processor 448 may determine the throttle input to send to the watercraft 100 based on the detected angular position of the thumbwheel interface 502. In one example, the remote controller 500 may transmit an 8-bit throttle value. For an 8-bit throttle value, the throttle output values range from 0-255 where a throttle value of 0 is sent when the thumbwheel interface 502 is determined to be in the resting position (see FIG. 6C) and a throttle value of up to 255 is sent as the thumbwheel interface 502 is rotated to the full throttle position (see FIG. 6D). The remote controller 500 may then send the determined throttle value (e.g., 0-255) to the watercraft 100. The remote controller 500 may send an 8-bit signal to the watercraft 100 with the throttle value. The remote controller 500 may send a flag along with the 8-bit signal to the watercraft 100 if noise or interference is determined to have caused the throttle input. The watercraft 100 may receive the throttle control signal and determine whether to carry out the throttle control command. The watercraft may provide power to the motor of the watercraft 100 to execute the throttle control command. The watercraft 100 may determine how much power to provide to the motor based on the ride mode selected by the user. For example, if the user selected a beginner mode with limited power, a full throttle input signal from the user may provide less than full power to the motor, e.g., 60% of full power.

In some forms, the evaluation of whether a throttle input is valid is performed by the processor of the watercraft 100. For example, the processor 448 may communicate the raw Hall effect sensor 501 data to the watercraft 100 for processing, evaluation of valid throttle input, and output of throttle commands. In other forms, some of the processing may be performed by the processor 448 of the remote controller 500 while other steps are performed by the processor of the watercraft 100.

The remote controller 500 may be configured to receive voice commands from a rider to control the watercraft 100. As explained above, the user interface 426 may include a microphone into which the user may speak control commands that are received by the remote controller 500. The processor 448 of the remote controller 500 may include voice recognition software to process the user's voice commands. The remote controller 500 may determine the user's voice command, identify a control input corresponding to the user's voice command, and generate a throttle input or other control command to send to watercraft 100. The voice commands may include, as examples, to "move forward," "reverse," "move forward at 10 knots," "bring me home," "maintain ride height," "steer left," "call for help." In some forms, the user may be required to press an input button 430 or move the thumbwheel interface 502 to the full throttle position to speak a voice command. The remote controller 500 may begin listening for voice commands in response to the user pressing the input button 430 or moving the thumbwheel interface 502. The user may be required to hold the thumbwheel interface 502 in the full throttle position while the watercraft 100 operates in response to voice commands of the user. The thumbwheel interface 502 may thus serve as an enabling switch causing the watercraft 100 to cease operation when the user releases the thumbwheel interface 502, for example, when the user has fallen off of the watercraft 100. In some forms, the processor receives the voice command from the user and communicates the voice command data to the watercraft 100 for further processing. For example, the watercraft 100 may include voice recognition software for identifying voice commands from the user's spoken commands received by the microphone. The watercraft 100 may then identify the control command corresponding to the user's voice command and adjust the operation of the watercraft 100 accordingly.

In some forms, the watercraft 100 additionally or alternatively includes a microphone such that the watercraft 100 (e.g., a computer of the watercraft 100, such as battery box 112) directly receives the user's voice commands, identifies the corresponding control input associated with the voice command, and implements the control input. Including a microphone on the watercraft 100 may be advantageous in situations where the user loses the remote controller 500 or the remote controller 500 stops working (e.g., the battery charge is too low). The user may then use voice commands, for example, to drive the watercraft 100 back to shore. As mentioned above, the user may speak a command to "bring me home" which the watercraft 100 may be configured to autonomously bring the user back to a starting location such as a dock or beach where the user started using the watercraft 100, for example, location data collected by GNSS circuitry. The user may also use the microphone to call for help. The remote controller 500 or watercraft 100 may then call for help to have someone rescue or assist the user. In some forms, the remote controller 500 or watercraft 100 places a phone call to support staff or emergency personnel permitting the user to explain their problem.

The remote controller 500 may be configured to receive control commands through gestures made by the user holding the remote controller or by moving, twisting, or tilting the remote controller 500. As one example, the user may tilt the remote controller 500 downward and upward as indicated by arrows 482, 484 to control the watercraft 100 (see FIG. 6A). For instance, the user may tilt the remote controller 500 downward in the direction of arrow 484 to cause the watercraft 100 to move forward. In some forms, the further the user tilts the remote controller 500, the faster the watercraft 100 travels. The user may tilt the remote controller 500 in the direction of arrow 482 to slow the watercraft 100 and/or cause the remote controller 500 to move in reverse. Similarly, the remote controller 500 may be tilted from side-to-side, for example in the direction of arrows 460, 462 (see FIG. 6A), to provide control commands, such as throttle input, steering input, and the like. The remote controller 500 may use the data generated by the IMU 454 to determine the orientation of the remote controller 500, to identify gestures may by the user, and to output corresponding control commands to the watercraft 100. For example, the processor 448 may use data from the IMU to determine the orientation of the remote controller 500 and to generate control commands as explained above for the watercraft 100. In some forms, the user may be required to move the thumbwheel interface 502 to the full throttle position before tilting the remote controller 500 to send a control command to the watercraft 100. The remote controller 500 may use the orientation of the remote controller 500 when the thumbwheel interface 502 is moved to the full throttle position as the base or reference orientation (e.g., to mitigate the effect of sensor drift). The orientation of the thumbwheel interface 502 may then be measured relative to the measured orientation when the user pressed the thumbwheel interface 502. The user may be required to hold the thumbwheel interface 502 in the full throttle position while the watercraft 100 operates in response to control inputs by the user moving, twisting, or tilting the remote controller 500. The thumbwheel interface 502 may thus serve as an enabling switch causing the watercraft 100 to cease operation when the user releases the thumbwheel interface 502, for example, when the user has fallen off of the watercraft 100. Controlling the watercraft 100 by tilting the remote controller 500, instead of by moving the thumbwheel interface 502, may be easier for beginners who are still learning to maintain their balance on the watercraft 100 as then they do not also have to learn to move the thumbwheel interface 502 with the degree of finesse that may be required. Likewise, controlling the watercraft 100 by tilting the remote controller 500 may be advantageous for individuals who lack dexterity or strength in their thumb.

As another example, the remote controller 500 may use data generated by the accelerometer of the IMU 454 for controlling the watercraft 100. As one example, the watercraft 100 may be configured to operate in a series of operational modes that each have progressively more power and speed. The operational modes may be similar to the "gears" of a transmission of an automobile, where "shifting up" to a higher operational mode unlocks a higher top speed and/or a greater rate of acceleration and "shifting down" to a lower operational mode reduces the top speed and/or lowers the rate of acceleration. For instance, in the lowest "gear" or operational mode, the watercraft 100 may only be able to travel up to a certain maximum speed when the thumbwheel interface 502 is moved to the full throttle position. The user may then shift up to the next gears or operational modes to travel at greater speeds or with greater rates of acceleration. Likewise, the user may shift down to the lower gears or operational modes to have a more limited top speed and/or rates of acceleration. In one form, the user may shift between gears by rapidly moving or flicking the display portion 420 of the remote controller 500, for example, in the directions indicated by arrows 460, 462 or in the directions indicated by arrows 482, 484 (see FIG. 6A). For instance, the user may flick the remote controller 500 to the right to shift up and to the left to shift down during operation of the watercraft 100. The processor 448 may receive data generated by the accelerometer of the IMU 454 and determine when the user has gestured to shift up or down. The remote controller 500 may communicate the gear selection to the watercraft 100 or may adjust the throttle control signals sent to the watercraft 100 based on the gear or operational mode the user is operating in. Those having skill in the art will understand that while the processing of the IMU 454 data is described as being processed on the remote controller 500, the IMU data may similarly be communicated to the watercraft 100 or another processing device to determine whether the user has gestured or otherwise moved the remote controller 500 to provide a control input or command.

As mentioned above, in some forms the thumbwheel interface 502 may be configured to slide or be tilted laterally or in the direction of arrows 460, 462 of FIG. 6A. For example, the user may use their thumb to slide or tilt the thumbwheel interface 502 toward the left or right side of the remote controller 500. This motion of the thumbwheel interface 502 may be used to provide another input to the remote controller 500 or watercraft 100. The processor 448 may receive data from the Hall effect sensor 501 and determine when the thumbwheel interface 502 has been moved laterally. In some forms, moving the thumbwheel laterally may move between GUI screens or options displayed on the display screen 428 of the remote controller 500. In some forms, the thumbwheel interface 502 may be moved laterally to "shift up" and "shift down" between operational modes similar to that described above with the use of accelerometers. For example, the user may slide or tilt the thumbwheel interface 502 to the right side of the remote controller 500 to shift to a higher gear or operational mode and slide or tilt the thumbwheel interface 502 to the left side of the remote controller 500 to shift to a lower gear or operational mode.

The processor 448 is configured to cause the display screen 428 of the user interface 426 to display a GUI providing information to the user. The processor 448 is configured to receive input from the input buttons 430 of the user interface 426 to receive input and selections from the user, for example, based on what is displayed on the GUI of the display screen 428. The user may be able to view information pertaining to the remote controller 500 and/or the watercraft 100 on the display screen 428, for example, the information shown in FIG. 7. The user interface 426 may permit the user to select the different ride modes such as those discussed above. The input buttons 430 may be within the housing 508 and accessible through holes or openings in the plastic body of the housing 402. The rubber layer extends over the holes or openings keeping the cavity 408 of the housing 508 sealed while permitting access to the input buttons 430 such that the buttons 430 may be actuated by depressing a portion of the rubber layer.

The watercraft 100 may have standard ride modes or profiles that a user may select when operating the watercraft 100. As described above, the ride modes or profiles may provide the user with varying amounts of power, top speeds, and rates of acceleration. For instance, a beginner ride mode may have a limited amount of power, a lower top speed and a slower rate of acceleration as compared to the more advanced ride modes or profiles. The user may use the remote controller 500 to select the ride mode or profile. In some forms, the remote controller 500 does not store the options selectable by a user (such as ride modes), but instead communicates with the watercraft 100 to receive the options for the user to select and the corresponding GUI to display to the user on the display screen 428. The remote controller 500 may serve as a user interface of the computer in the watercraft 100 through which the user is able to make selections of ride modes, features, and view data stored in the computer of the watercraft 100. Such a configuration of remote controller 500 where the remote controller serves as a "window" into the computer of the watercraft 100 is advantageous as the remote controller 500 may not need to be updated to unlock new features and ride modes. Instead, the computer of the watercraft 100 may receive the software and firmware updates for implementing new features (e.g., ride modes, etc.) without needing to also update the remote controller 500 (e.g., provide firmware or software updates). This also permits users to create their own custom ride modes and upload them to the watercraft 100. For example, a user may create a custom ride mode tailored to their riding style. A user may, for example, create a custom table for the amount of power provided to the motor based on the detected angular position of the thumbwheel or the throttle input received from the remote controller 500. A user may create their custom ride mode on a smartphone application or via a computer program and load the custom ride mode to the computer of their watercraft 100. The user may load the custom ride mode directly to the computer of the watercraft 100 (e.g., via Bluetooth or Wi-Fi) or indirectly via a server computer associated with the watercraft 100 and application.

The remote controller 500 may include a pressure sensor that indicates when the remote controller 500 is underwater. The remote controller 500 may stop sending a throttle control signal upon detecting the remote controller 500 is underwater. The remote controller 500 may be underwater when, for example, the rider falls off of the board 102. Thus, by ceasing to transmit a throttle control signal, the motor of the watercraft 100 may be shut off automatically when the rider falls in the water. When the watercraft 100 ceases to receive the throttle control signal from the remote controller 500, the IPU may immediately cease to provide power to the propulsion unit 106, thus causing the propeller to cease rotating. The IPU may be configured to disregard the deceleration limits that may be selected or set to disable the motor if the rider falls overboard.

In some embodiments, the remote controller 500 may include a reed switch or a magnetic sensor that is used to activate the ride mode. For example, the rider may bring a portion of the remote controller 500 into contact with a magnet or contact on the top surface of the board 102. The reed switch or magnetic sensor may detect that the remote controller 500 was brought into contact with the board 102 and switch the remote controller 500 into a ride mode (out of the idle or locked modes). In one example, upon touching the board 102 with the remote controller 500, a countdown is started until the remote controller 500 switches into the ride mode at which point the rider may control the watercraft 100 via the remote controller 500. The ride mode may time out after a period of inactivity. For example, if the user does not engage the throttle control interface within 30 seconds, the remote controller 500 may switch back to the idle or locked mode.

In one embodiment, touching the remote controller 500 to the board 102 causes the remote controller 500 and the watercraft 100 to be linked or paired such that the remote controller 500 will send control signals to the watercraft 100 the rider touched the remote controller 500 to. This prevents a user from inadvertently controlling another watercraft 100 with a remote controller 500. The remote controller 500 may unpair or disconnect from the watercraft 100 after a period of inactivity following contact with the board 102. For example, if the user does not engage the throttle control interface within 30 seconds, the remote controller 500 may unpair from the watercraft 100. The user will then need to contact the board 102 with the remote controller 500 again to control the watercraft 100.

The remote controller 500 may include a strap or cord which may be wrapped or loops around a rider's wrist or arm to tether the remote controller 500 to the rider. If the rider falls and drops the remote controller 500, the remote controller 500 may remain attached to the rider. In some forms, the remote controller 500 floats. This may be due in part to the sealed watertight cavity within the controller 500.

The battery 458 of the remote controller 500 may be charged by placing the remote controller 500 on a charging dock. The battery 458 of the remote controller 500 may be charged inductively. This enables the battery and other components to remain sealed within the watertight cavity of the remote controller 500 without including any opening for wires to extend across the fluid tight seal. The charging dock may include a port 232 into which a charging cable may be inserted. The charging cable may be plugged into a wall outlet to provide power to the charging dock via the port. The charging dock may include a primary coil for charging the remote controller 500. The remote controller 500 may include a secondary coil that is aligned with the primary coil of the charging dock when the remote controller 500 is placed in the charging dock to enable the remote controller 500 to be charged inductively.

Figure 9:
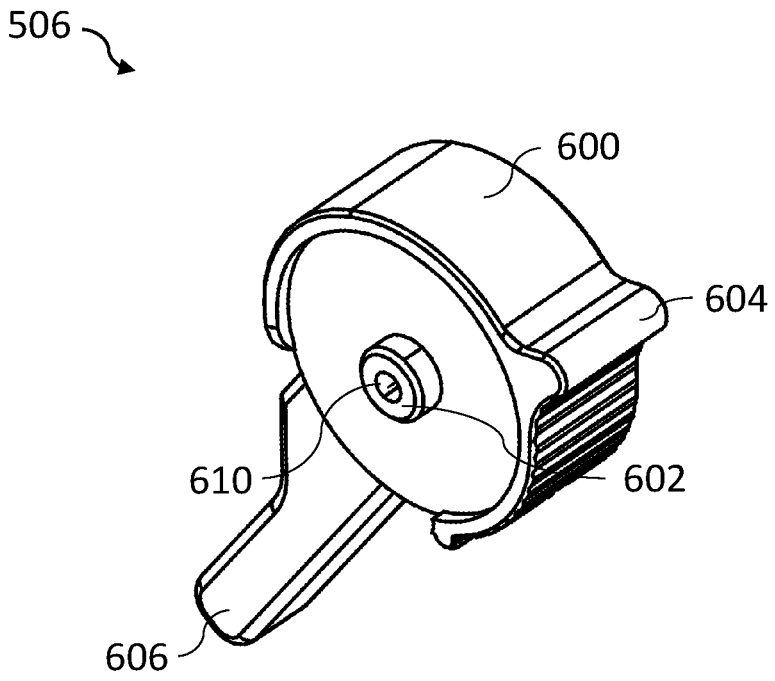
FIG. 9 is a perspective view of a thumbwheel/trigger interface for use with the controller of FIG. 3.
Figure 10A:
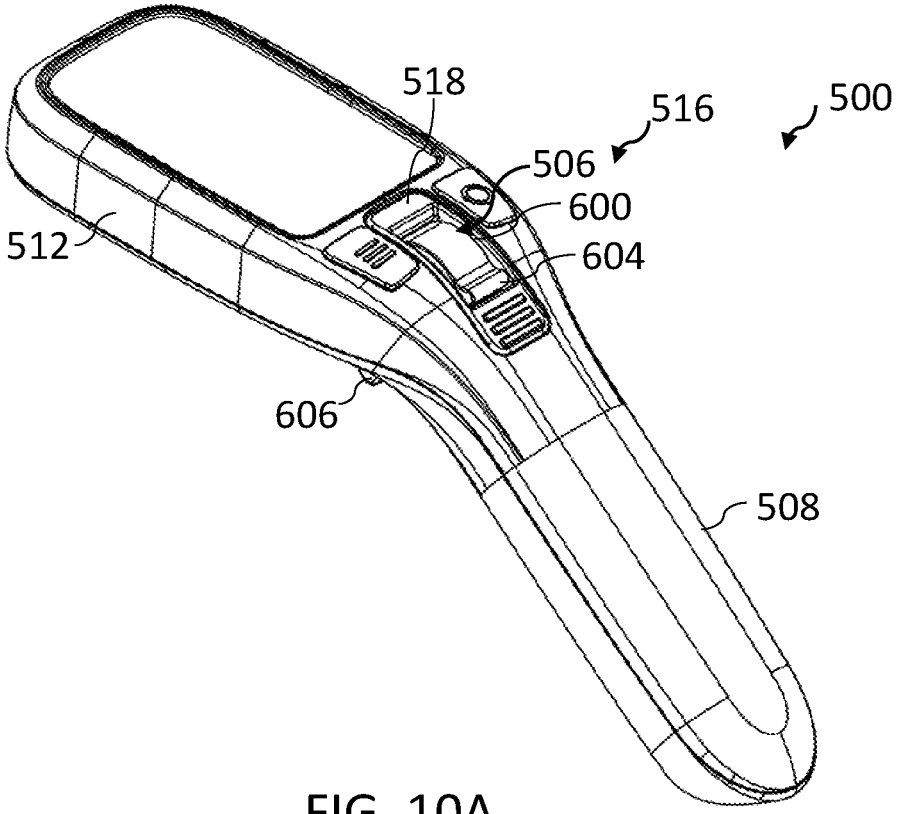
FIG. 10A is a perspective view of the controller of FIG. 3 including the thumbwheel/trigger interface of FIG. 9.
Figure 10B:
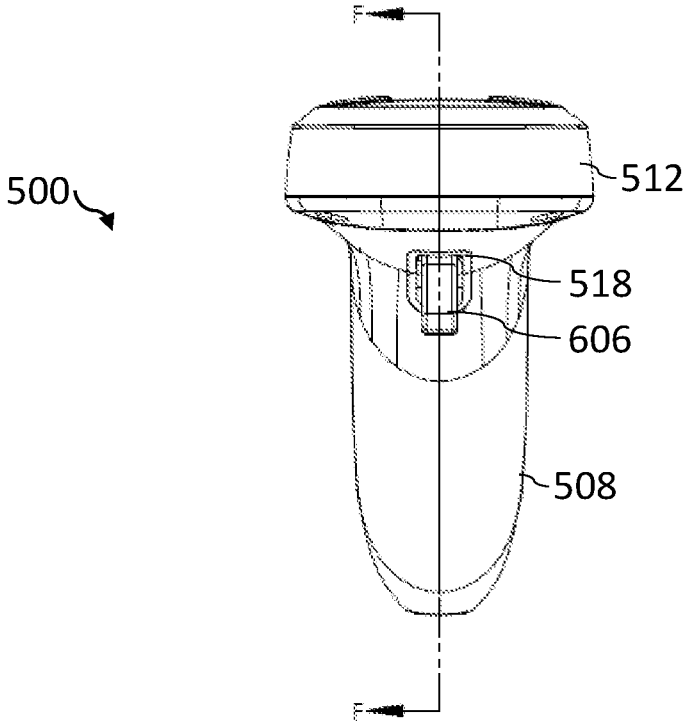
FIG. 10B is a front view of the controller of FIG. 10A.
Figure 10C:
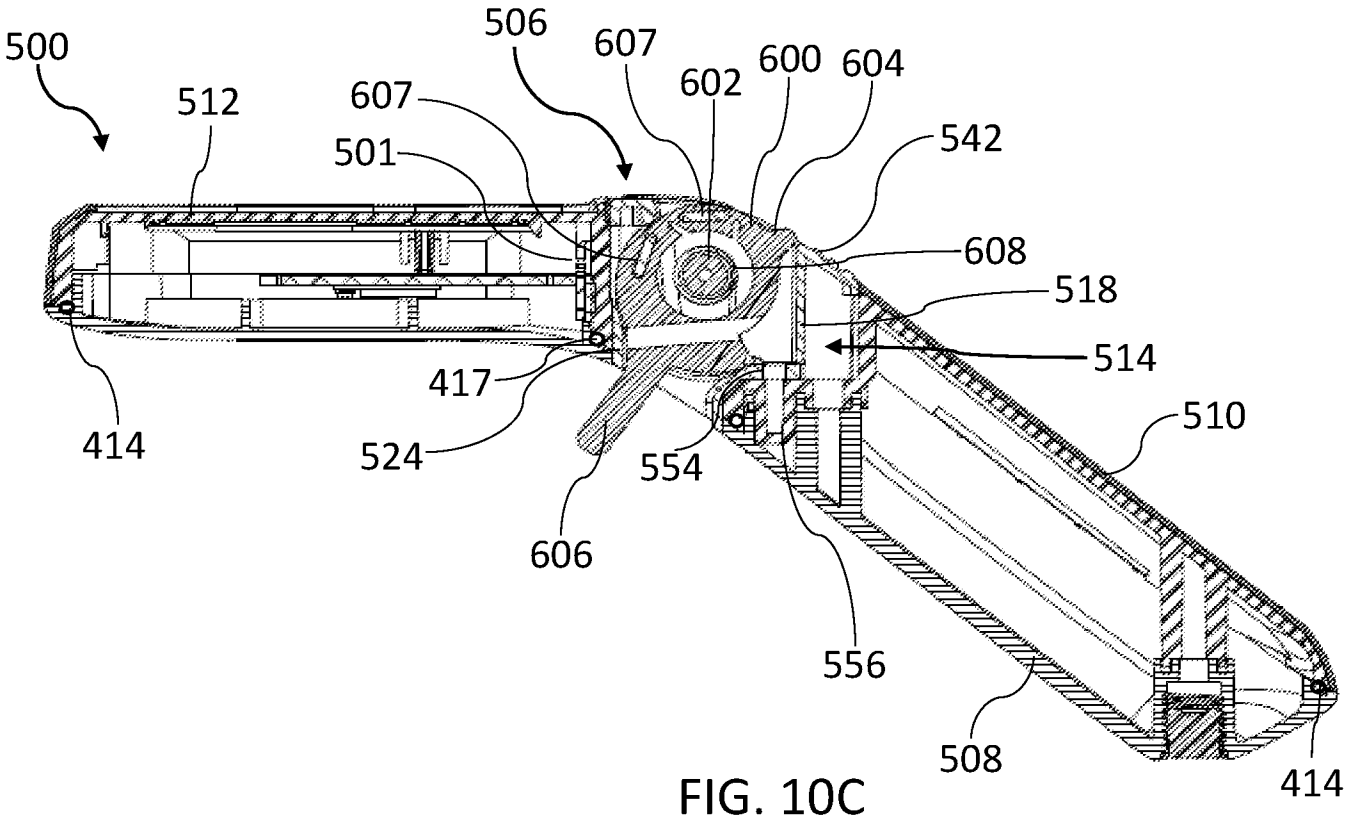
FIG. 10C is a cross-sectional view of the controller of FIG. 10A with the thumbwheel/trigger throttle interface in a first position.
Figure 10D:
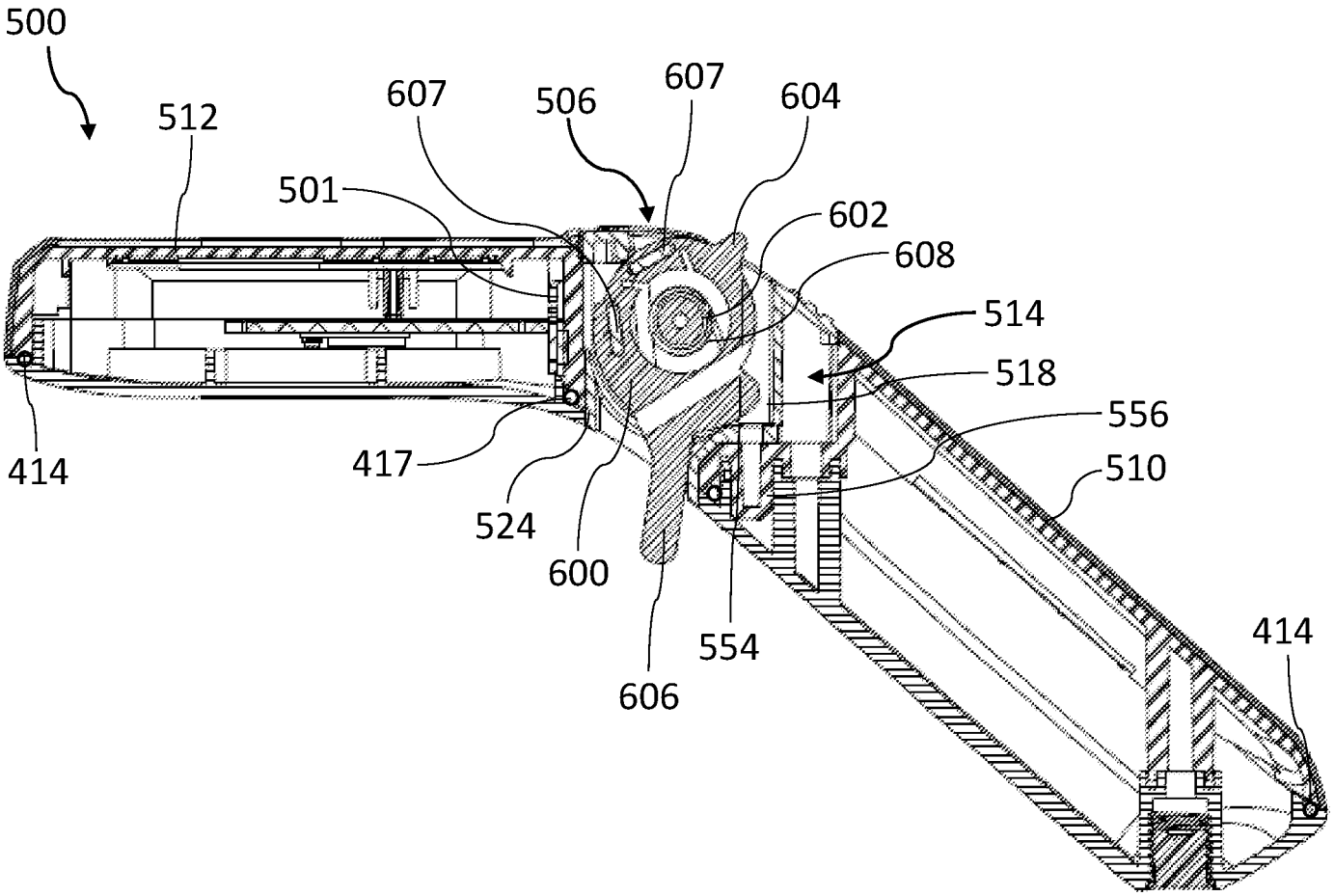
FIG. 10D is a cross-sectional view of the controller of FIG. 10A with the thumbwheel/trigger throttle interface in a second position.

With respect to FIG. 9, the trigger/thumbwheel interface 506 is provided that is similar in many respects to the thumbwheel interface 502 discussed above such that the differences will be highlighted. The trigger/thumbwheel interface 506 includes an outer body 600 and a support rod 602 about that defines an axis about which the outer body 600 is able to rotate. The support rod 602 may include an opening 610 configured to receive a screw. The outer body 600 includes a protrusion 604 extending radially from a first portion of the outer body 600 and a trigger 606 extending radially from a second portion of the outer body 600. The trigger 606 extends from the outer body 600 at a position substantially opposite of the protrusion 604. The trigger 606 and/or protrusion 604 may be used to rotate the outer body 600 about the support rod 602 between a first position (see FIG. 10C) and a second position or "full throttle" position (see FIG. 10D). The trigger/thumbwheel interface 506 may include a biasing member such as a torsion spring 608 mounted to the support rod 602 and connected to the outer body 600 to bias the trigger/thumbwheel interface 506 toward the first position.

With respect to FIGS. 10A-10D, the trigger/thumbwheel interface 506 may be attached to the cartridge 518 similarly to the thumbwheel interface 502. The trigger/thumbwheel interface 506 may be inserted into the cavity 534 of the cartridge 518 with the trigger 606 extending out of the lower portion 524 of the cartridge 518. The support rod 602 of the trigger/thumbwheel interface 506 may be secured to the cartridge 518, for example, using the holes 536, 538 of the cartridge 518 as described above with respect to the thumbwheel interface 502. The cartridge 518 may be inserted into the through hole 514 of the housing 508 and secured to the housing by extending a fastener through the opening 554 of the cartridge 518 and into the mounting hole 556 of the housing 508.

When the cartridge 518 is inserted into the housing 508 as shown in FIGS. 10A-10D, the trigger 606 extends out of the cartridge 518 and from the lower side of the housing 508. A user holding the handle 510 of the housing 508 with their hand may use their index finger to pull or squeeze the trigger 606 to overcome the biasing force of the torsion spring 608 and move the trigger 606 from the first position(see FIG. 10C) toward the second position (see FIG. 10D). Additionally, when the cartridge 518 is inserted into the housing 508, the protrusion 604 extends from the through hole 514 at the upper side of the housing 508. A user holding the handle 510 of the housing 508 with their hand may use their thumb to move the protrusion 604 forward and/or rearward to adjust the position of the protrusion 604, for example, move the protrusion 604 from the first position toward the second position. Moving the trigger 606 and/or protrusion 604 rotates the outer body 600 which moves the magnets 607 of the thumbwheel/trigger interface 506. The sensor 501 of the remote controller 500 may detect the position of the magnets 607 to determine the position of the trigger/thumbwheel interface 506 and output corresponding throttle control signal as discussed in the embodiments above.

The remote controller 500 may determine the type of throttle interface installed in the cartridge 518 and may output throttle control signals based on the detected type of throttle interface. For example, the remote controller 500 may include a NFC reader configured to read an NFC chip mounted to the cartridge 518 and/or throttle interface 502, 504, 506. As another example, the position or type of the magnets 607 of the trigger/thumbwheel interface 506 may be different than the in the thumbwheel interface 502 which is detectable by the sensor 501. Based on the type of throttle control interface, the remote controller 500 may reference different data sets to determine the position of the throttle control interface and output a throttle control signal. Moreover, in the example embodiments of the thumbwheel interface 502 and trigger/thumbwheel interface 506 shown, the range of mechanical rotation of the trigger/thumbwheel interface 506 is less than that of the thumbwheel interface 502. To ensure the full range of throttle outputs are available to the user, the remote controller 500 may account for the type of throttle control interface when outputting a throttle control output upon determining the mechanical angle of the throttle control interface (e.g., such that the throttle output of the remote controller in the full throttle position is the same regardless of the throttle control interface).

The user may use one or both of the trigger 606 and the protrusion 604 to control the position of the outer body 600 (and thus the magnets 607) to control the throttle. For example, a user may use their thumb and their index finger to move the protrusion 604 and trigger 606 to rotate the outer body 600 to the desired position. For instance, a user may squeeze the trigger 606 to set the trigger/thumbwheel interface 506 at the desired position and may rest their thumb on the upper surface 542 of the cartridge 518 and against the rear side of the protrusion 604 to act as a stop to inhibit the protrusion 604 from returning to the first position. This may reduce fatigue in the user's hand that may result when only using the trigger 606 for control where the user has to continue to hold the trigger 606 at the desired position for an extended period of time. Using both the protrusion 604 and trigger 606 may also provide the user with fine control of the position of the outer body 600 of the trigger/thumbwheel interface 506. For example, a user's hand is less likely to slip off of both the trigger 606 and the protrusion 604 permitting the user to maintain control even when the user slips off of one of the trigger 606 and the protrusion 604. The trigger/thumbwheel interface 506 permits the user to have a greater degree of finesse when rotating the outer body 600 to reduce rapid accelerations or decelerations of the watercraft making the watercraft easier to operate. Having the trigger 606 and the protrusion 604 also provides the user with alternative methods of controlling the throttle. A user may switch between use of the protrusion 604 of the thumbwheel and the trigger 606, for example, when the user experiences fatigue from using one method without having to retrieve a different remote controller 500 or swap the throttle control interface.

Figure 11:
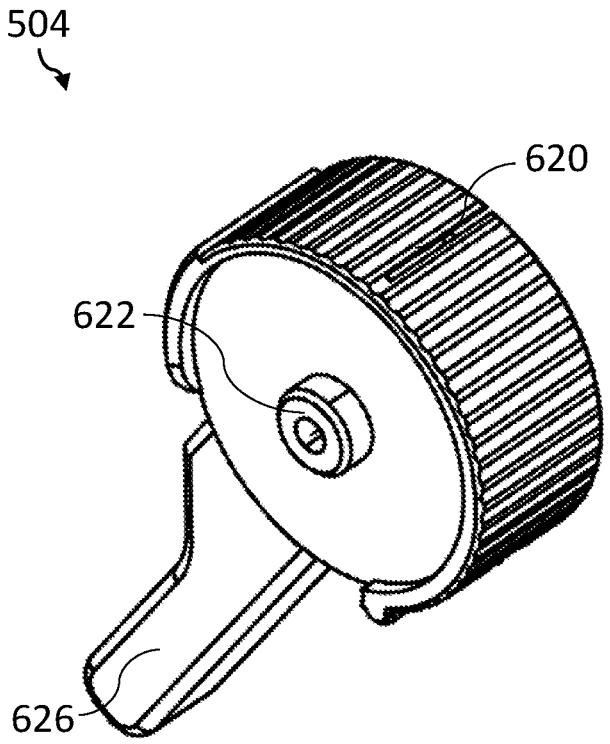
FIG. 11 is a perspective view of a trigger interface for use with the controller of FIG. 3.
Figure 12A:
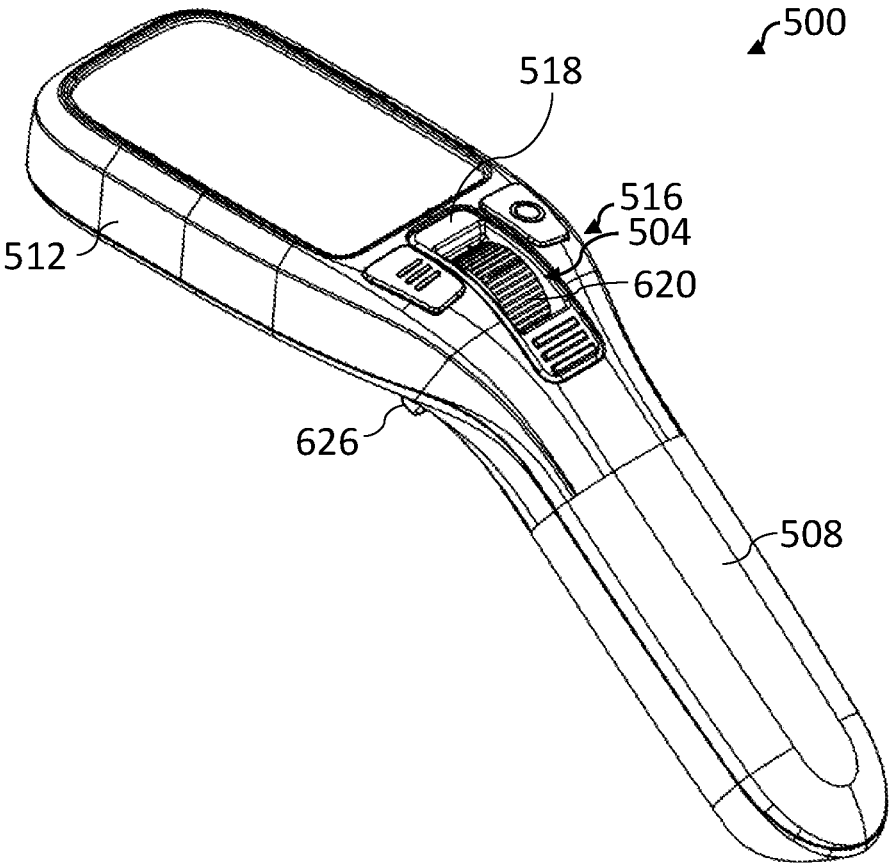
FIG. 12A is a perspective view of the controller of FIG. 3 including the trigger interface of FIG. 11.
Figure 12B:
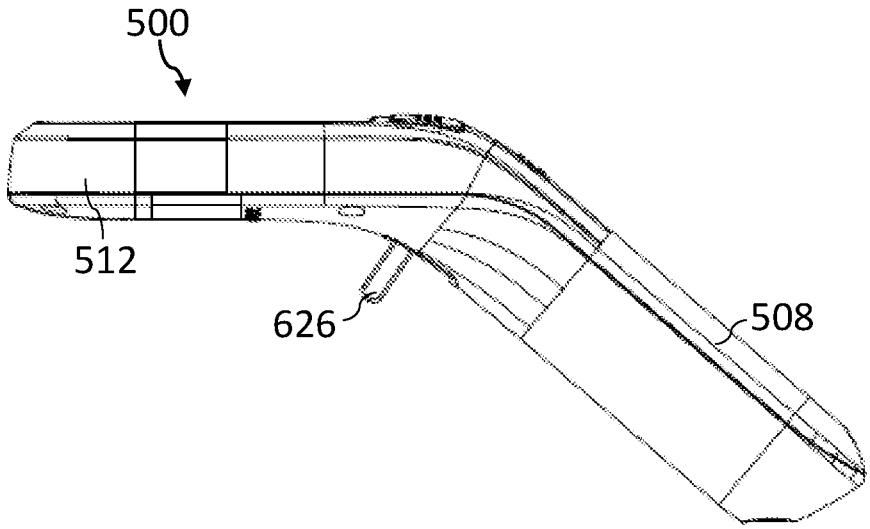
FIG. 12B is a side view of the controller of FIG. 12A.
Figure 12C:
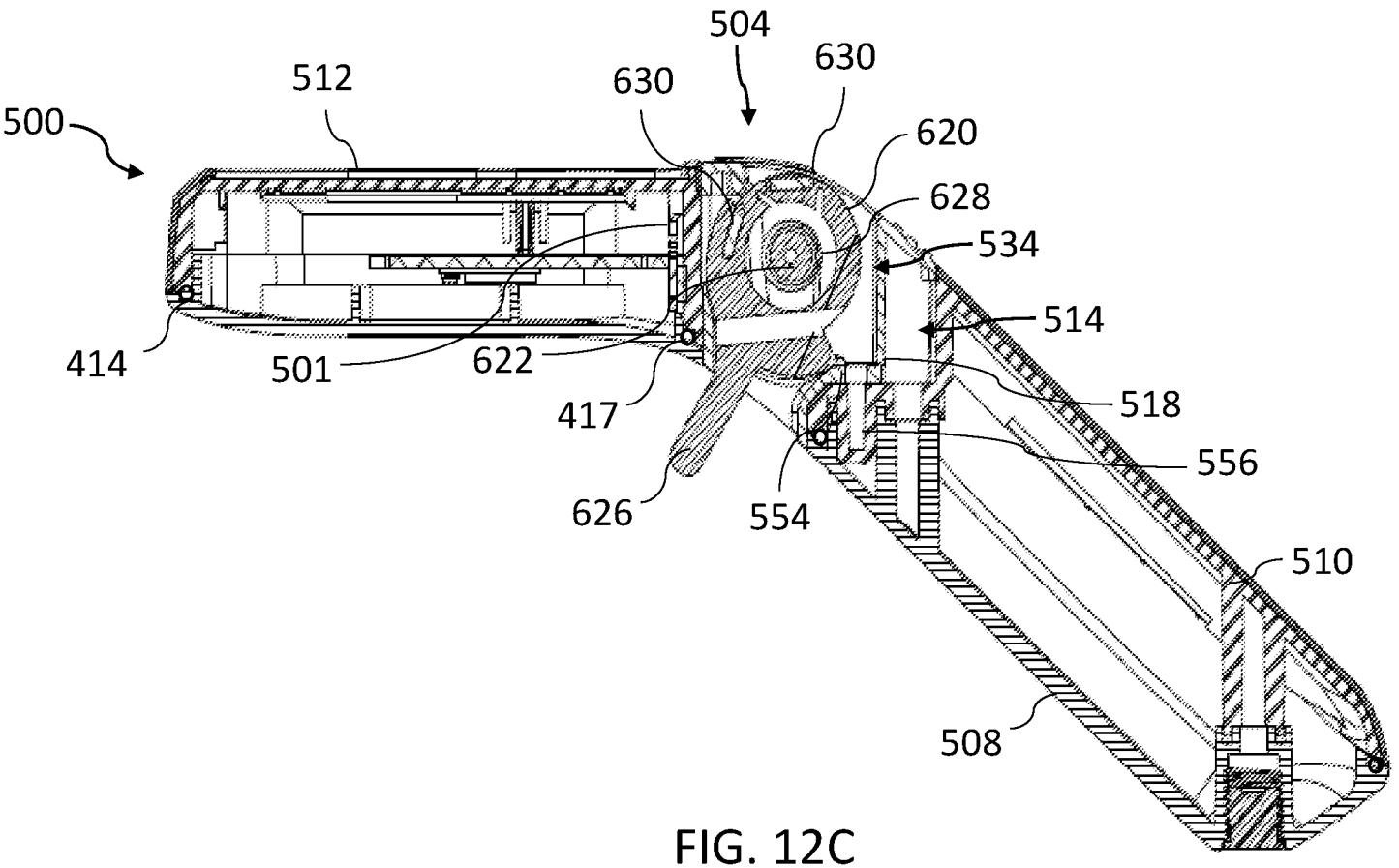
FIG. 12C is a cross-sectional view of the controller of FIG. 12A with the trigger interface in a first position.
Figure 12D:
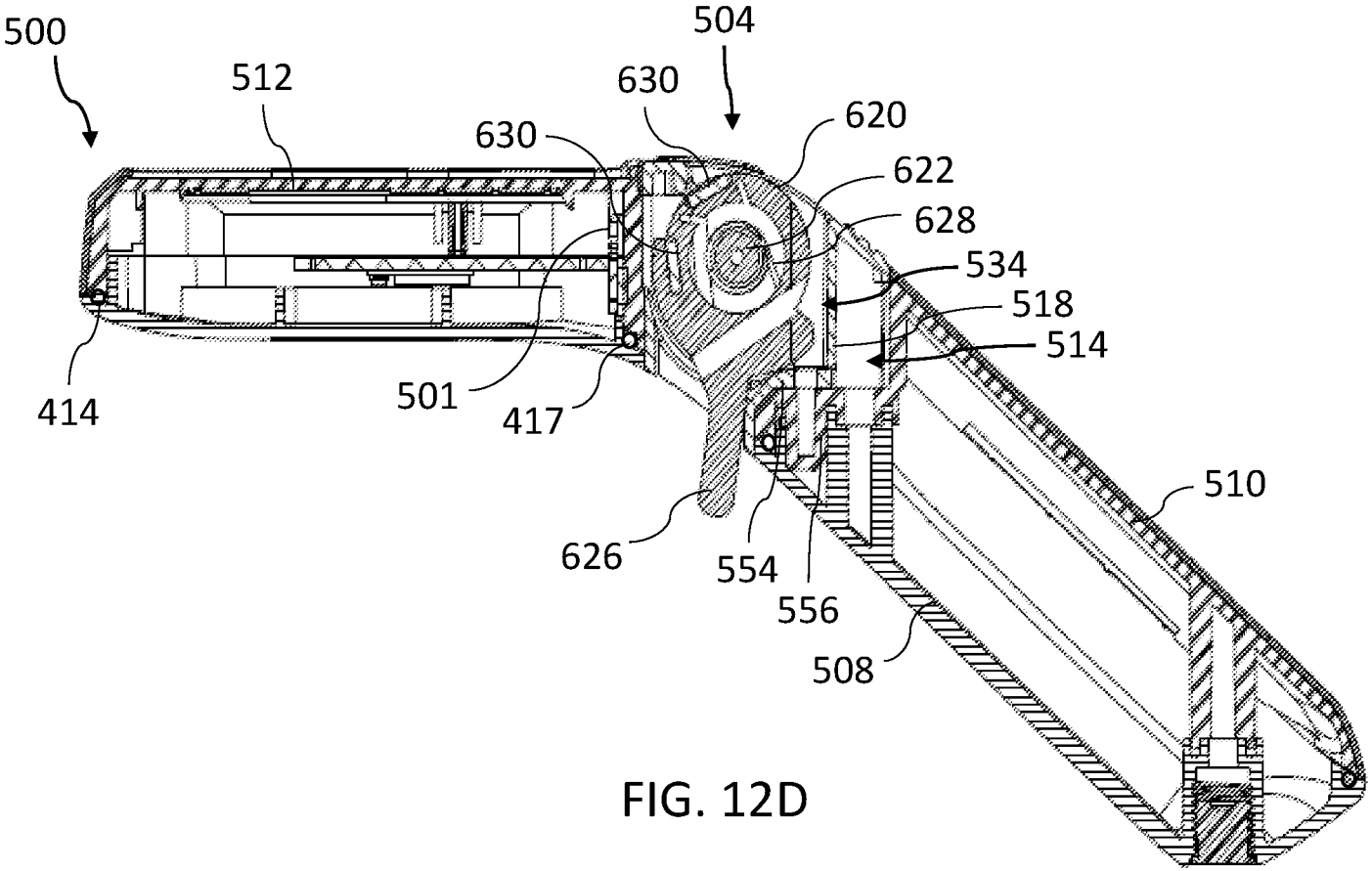
FIG. 12D is a cross-sectional view of the controller of FIG. 12A with the trigger interface in a second position.

With respect to FIG. 11, a trigger control interface 504 is provided that is similar in many respects to the trigger/thumbwheel interface 506 discussed above such that the differences will be highlighted. The trigger interface 504 includes an outer body 620 and a support rod 622 about which the outer body 620 is able to rotate. The support rod 622 defines an axis about which the outer body 620 rotates. The outer body 600 includes a trigger 626 extending radially from the outer body 600. In contrast to the trigger/thumbwheel interface 506, the trigger control interface 504 does not include a protrusion for a user's thumb to engage. The trigger 626 may be used to rotate the outer body 620 about the support rod 602 between a first position (see FIG. 12C) and a second position or "full throttle" position (see FIG. 12D). The trigger interface 504 may include a biasing member such as a torsion spring 628 mounted to the support rod 622 and connected to the outer body 620 to bias the trigger interface 504 toward the first position.

With respect to FIGS. 12A-12D, the trigger interface 504 may be attached to the cartridge 518 similarly to the thumbwheel interface 502 and trigger/thumbwheel interface 506 discussed above. The trigger interface 504 may be inserted into the cavity 534 of the cartridge 518 with the trigger 626 extending out of the lower portion 524 of the cartridge 518. The support rod 622 of the trigger interface 504 may be secured to the cartridge 518, for example, using the holes 536, 538 of the cartridge 518 or the other attachment methods described above with respect to the thumbwheel interface 502. The cartridge 518 may be inserted into the through hole 514 of the housing 508 and secured to the housing by extending a fastener through the opening 554 of the cartridge 518 and into the mounting hole 556 of the housing 508 as described above When the cartridge 518 loaded with the trigger interface 504 is inserted into the housing 508 as shown in FIGS. 12A-12D, the trigger 626 extends out of the cartridge 518 and from the lower side of the housing 508. A user holding the handle 510 of the housing 508 with their hand may use their index finger to pull or squeeze the trigger 626 to overcome the biasing force of the torsion spring 628 and move the trigger 626 from the first position toward (see FIG. 12C) to the second position (see FIG. 12D). Moving the trigger 626 rotates the outer body 600 which moves magnets 630 of the trigger interface 504. The sensor 501 of the remote controller 500 may detect the position of the magnets 630 to determine the position of the trigger interface 504 and output corresponding throttle control signal as discussed in the control interface 502 and 506 examples above.

Figure 13A:
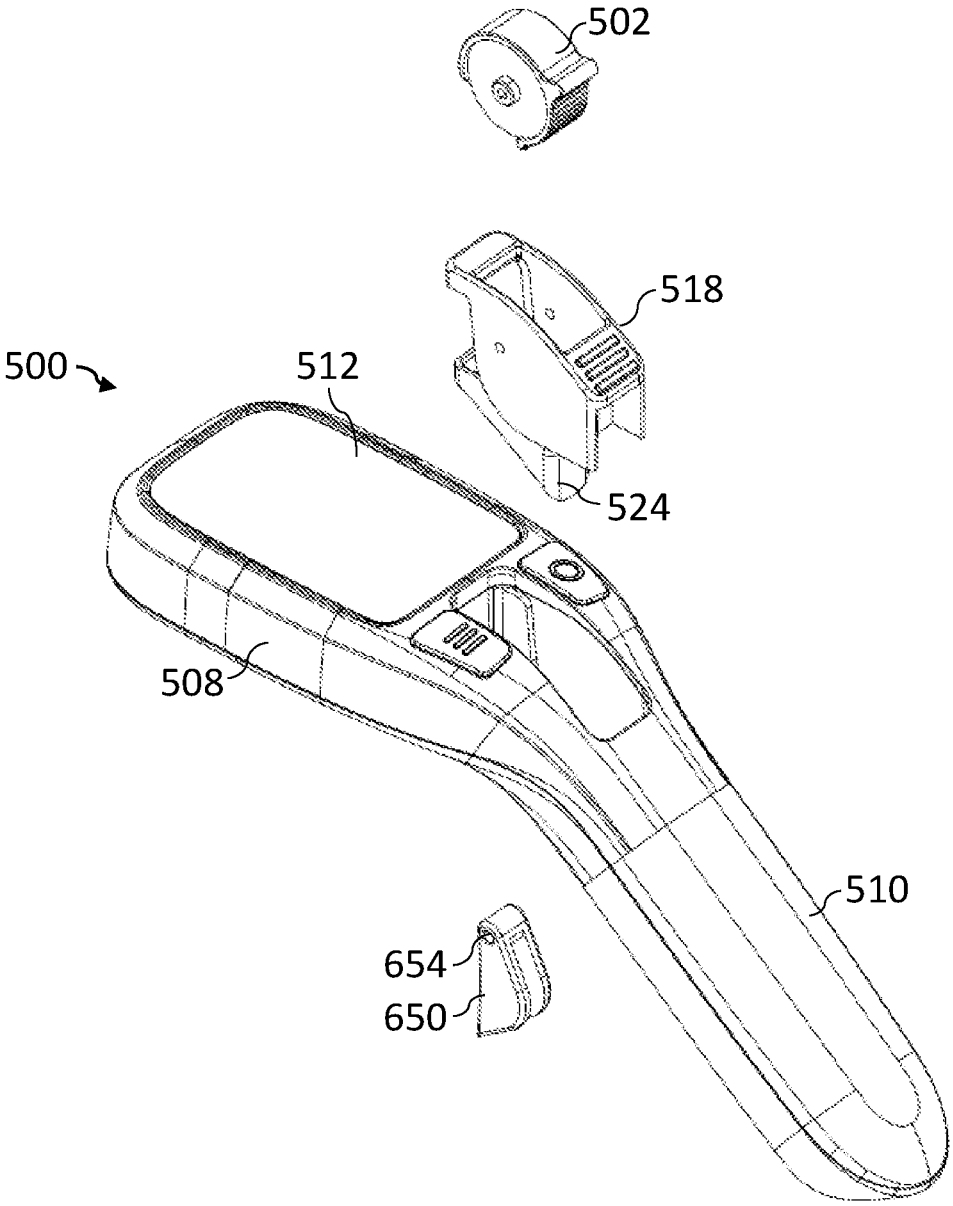
FIG. 13A is an exploded view of the controller of FIG. 3 including a throttle lock.
Figure 13B:
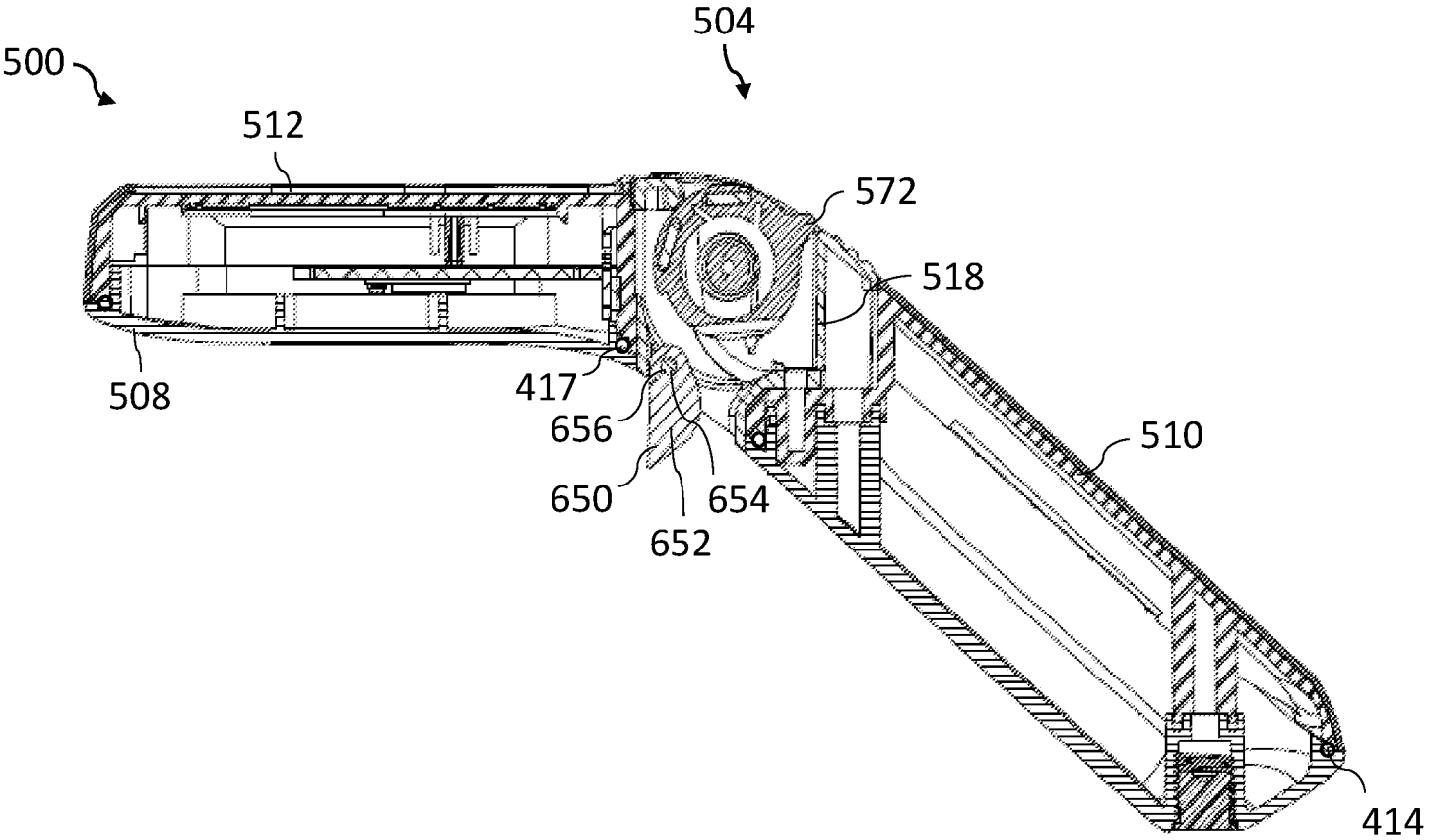
FIG. 13B is a cross-sectional view of the controller of FIG. 13A in an assembled configuration with the throttle lock in a first position.
Figure 13C:
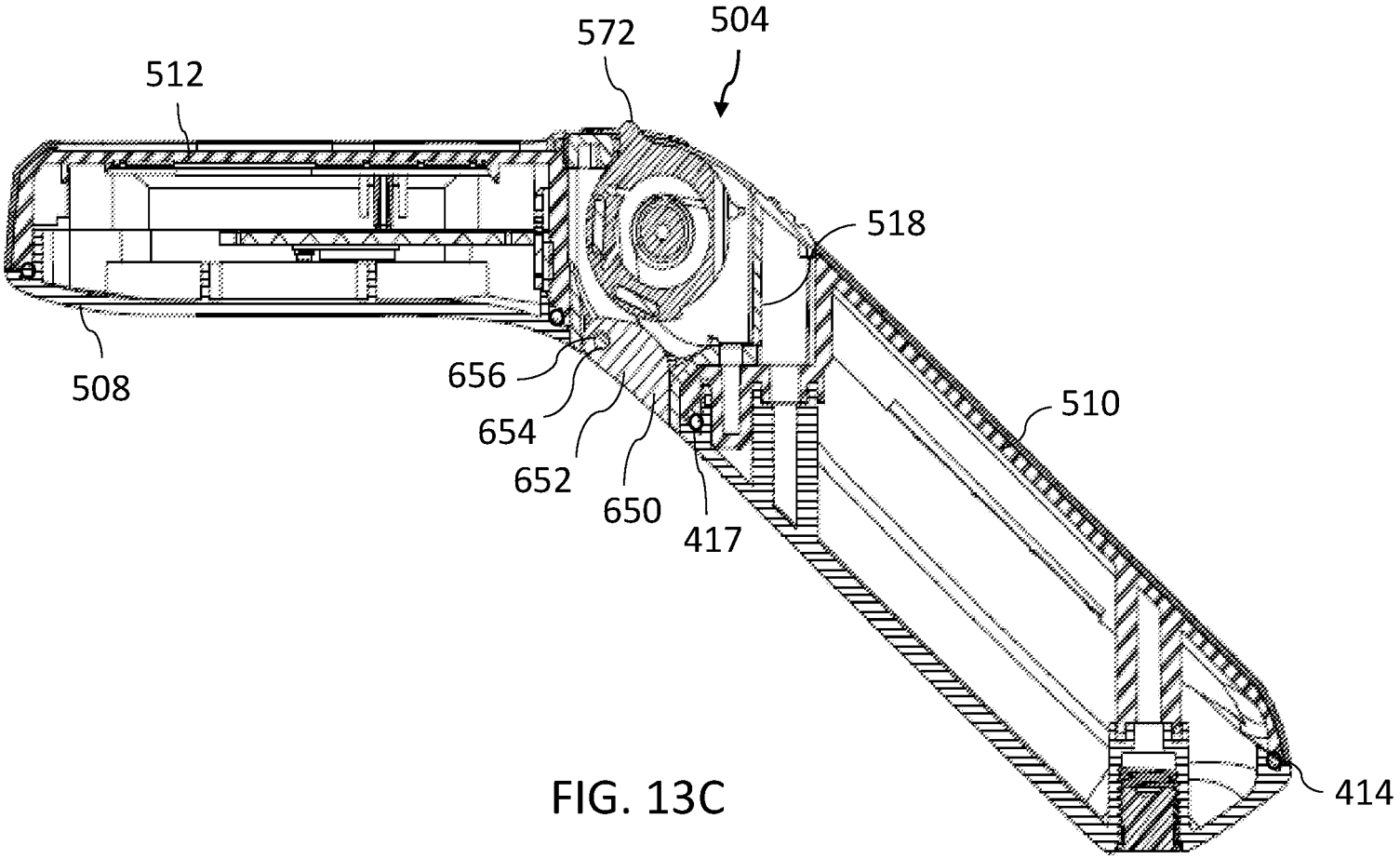
FIG. 13C is a cross-sectional view of the controller of FIG. 13A in an assembled configuration with the throttle lock in a second position.

With respect to FIGS. 13A-13C, the cartridge 518 may include a lever 650 for locking and unlocking the throttle control interface such as the thumbwheel interface 502. The lever 650 may be attached to the lower portion 524 of the cartridge 518 and able to pivot between a first position (see FIG. 13B) and a second position (see FIG. 13C). The lever 650 may include a body 652 having an opening 654 at an end thereof. The lever 650 may include an axle or rod 656 that extends through the opening 654. The rod 656 may be secured to the lower portion 524 of the cartridge 518. For example, the cartridge 518 may include recesses that the ends of the rod 656 may be snapped into to secure the rod 656 to the cartridge 518. In other forms, the cartridge 518 includes opposing protrusions that mate with the opening 654 on either side of the lever 650 such that the lever 650 may be snapped onto the cartridge 518 with the protrusions extending into the openings 654.

The lever 650 may be biased toward the first position where the body 652 of the lever 650 extends away from the lower side of the housing 508 of the remote controller 500. In some forms, the lever 650 is biased toward the first position by a torsion spring that engages the lower portion 524 of the cartridge 518 and the body 652 of the lever 650. The user may apply a force to the front surface 658 of the lever 650 to overcome the biasing force to move the lever 650 from the first position toward the second position. For example, the user holding the handle 510 of the remote controller 500 may pull the lever 650 toward the second position using their index finger.

Figure 14A:
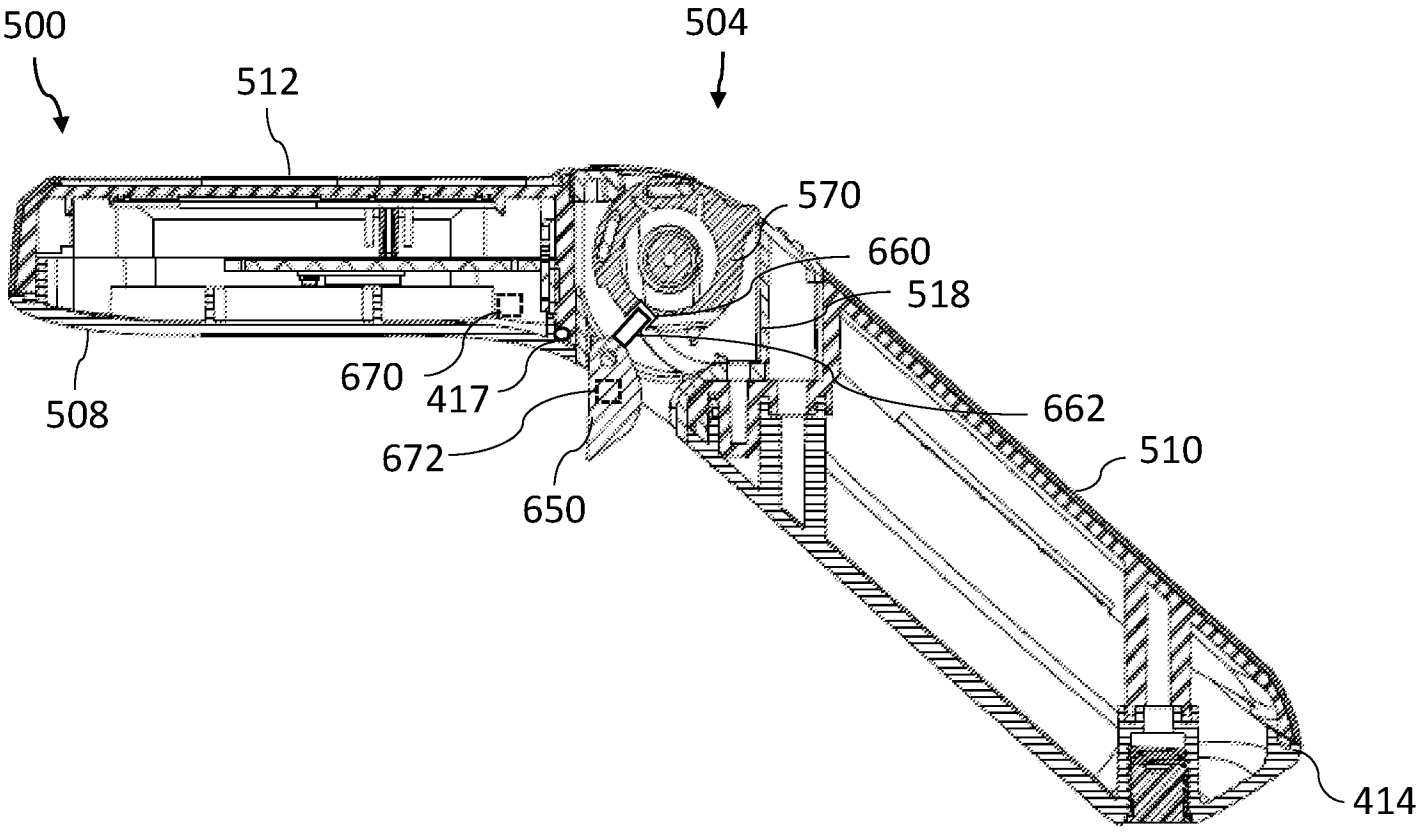
FIG. 14A is a cross-sectional view of the controller of FIG. 13A including a mechanical locking mechanism with the throttle lock in the first position.
Figure 14B:
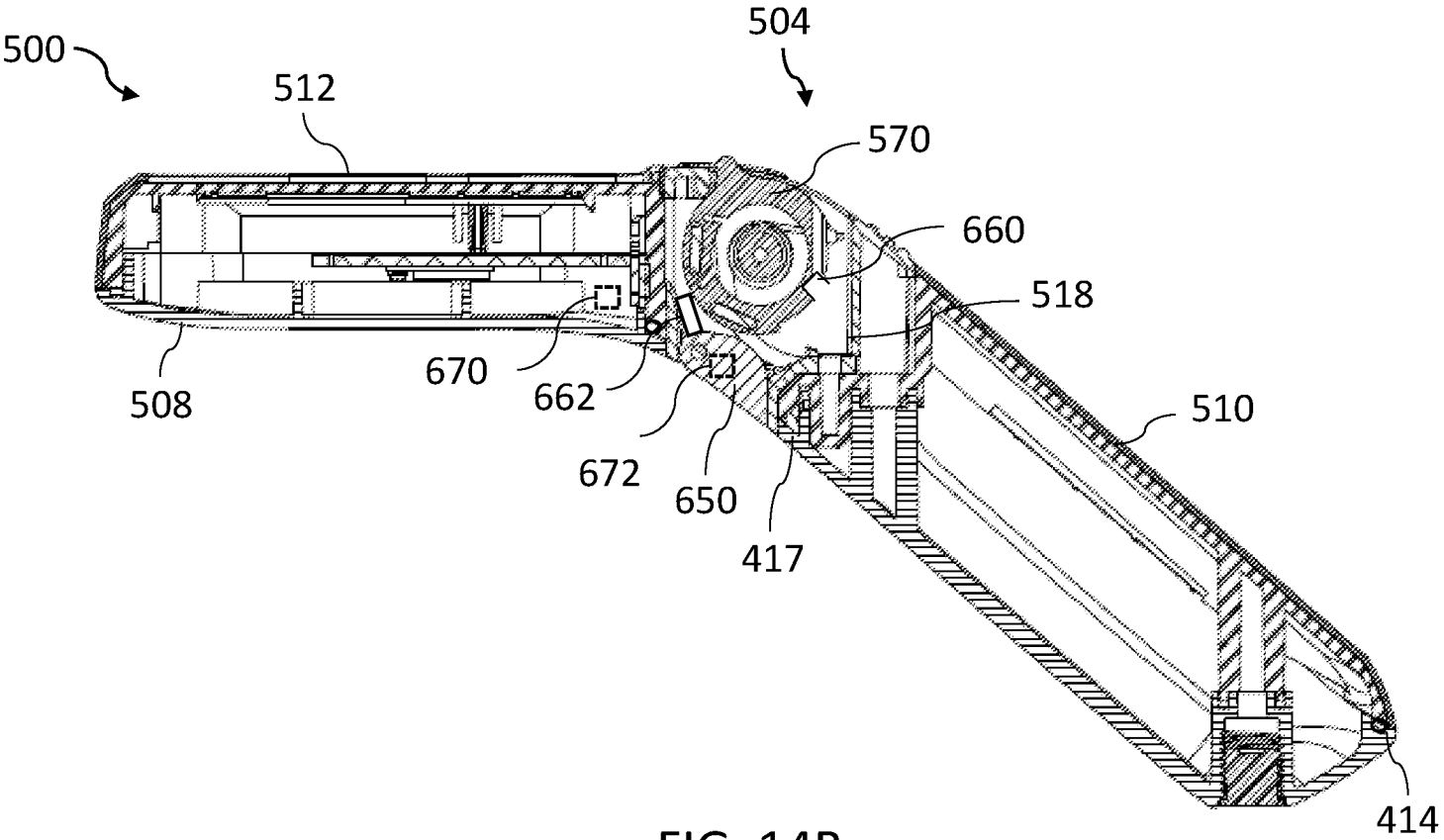
FIG. 14B is a cross-sectional view of the controller of FIG. 14A with the throttle lock in the second position.

The lever 650 may be used as a safety switch or throttle lock that the user engages to send throttle control signals to control a device, such as watercraft 100. For instance, control of the throttle may be locked when the lever 650 is in the first position and control of the throttle may be unlocked when the user moves the lever 650 to the second position. In one approach, the lever 650 is mechanically connected to the thumbwheel interface 502 such that the outer body 570 of the thumbwheel interface 502 is not able to be rotated until the user moves the lever 650 to the second position. In one form, and with reference to FIGS. 14A-14B, the thumbwheel interface 502 includes an opening 660 in the outer body 570 into which a stop bar 662 of the lever 650 is received when the lever 650 is in the first position (see FIG. 14A). With the stop bar 662 in the opening 660 of the outer body 570, the outer body 570 is not able to rotate. Rotation of the lever 650 from the first position to the second position withdraws the stop bar 662 (see FIG. 14B) from the opening 660 of the outer body 570 permitting the outer body 570 to rotate. For instance, the stop bar 662 may protrude from the lever 650. When the lever 650 is in the first position, the stop bar 662 extends toward the outer body 570 and into the opening 660. As the lever 650 is rotated, the stop bar 662 is withdrawn from the opening permitting the outer body 570 to rotate.

In another approach, the lever 650 may actuate a clutch system to selectively permit generation of a throttle control signal as the outer body 570 is rotated. For example, the thumbwheel interface 502 may include a cone clutch system. The outer body 570 of the thumbwheel interface 502 may include an outer wall including the protrusion and an inner body including the magnets 575 movable relative to the outer wall. The outer wall may include a conical interior surface and the inner body may include a conical outer surface. The inner body may be movable toward the outer wall to bring the conical outer surface of the inner body into frictional engagement with the conical interior surface of the outer wall such that rotation of the outer wall (e.g., by moving the protrusion) causes the inner body and thus the magnets 575 to rotate. When the inner body is not frictionally engaging the outer wall, rotation of the outer wall does not move the inner body or the magnets 575 and thus the sensor does not detect movement of the magnets 575 and thus no throttle control signal is generated or the throttle control output is zero. The lever 650 may be coupled to the inner body to move the inner body into and out of engagement with the outer wall. When the lever 650 is in the first position, the inner body is disengaged from the outer wall. Moving the lever 650 to the second position causes the inner body to move into frictional engagement with the outer wall thus permitting the magnets to be moved (and thus change the throttle control signal) upon movement of the outer wall. Releasing the lever 650 causes the lever 650 to return to the first position where the inner body is disengaged from the outer wall. The inner body may be biased toward its initial position such that releasing the lever 650 cuts the throttle of the watercraft.

Alternatively or additionally, a sensor 670 of the remote controller 500 may be used to determine the position of the lever 650. The sensor 670 may be sensor 501 or another sensor within the housing 508 of the remote controller 500 and in communication with the processor the remote controller 500. In one form, the lever 650 may include one or more magnets 672 disposed thereon and the sensor 670 may be a magnetic sensor to determine the orientation of the lever 650 similar to the approach described above with respect to determining the orientation of the thumbwheel interface 502. Where the processor determines the lever 650 is in the first position, the processor may inhibit throttle control signals from being sent to the associated device even if the user rotates the outer body 570 of the thumbwheel interface 502. When the processor determines the lever 650 is in the second position, the processor may permit throttle control signals to be sent as the user rotates the outer body 570 of the thumbwheel interface 502. When the user releases the lever 650, the lever 650 may spring back to the first position, at which point the processor may inhibit throttle control signals from being transmitted. Where the lever 650 is in a position intermediate the first position and the second position, the processor may be configured to permit throttle control signals when the lever 650 is within a certain range from the second position and to inhibit throttle control signals when the lever 650 is outside of the range. In some forms, the processor does not inhibit the throttle control signals from being sent but may include an indication of the position of the lever 650 in the control signal transmitted to the controlled device (e.g., the watercraft). The computing device of the controlled device may determine whether to respond to the control signal based on the determined position of the lever 650. The lever 650 may thus be used as a throttle lock that the user must first engage to permit the user to control the device. For example, where the user is not holding the lever 650 in the second position, moving the outer body 570 of the thumbwheel interface 502 (e.g., intentionally or inadvertently) will not result in operation of the controlled device. The user must hold the lever 650 at the second position for the throttle control signals generated based on the position of the outer body 570 of the thumbwheel interface 502 to be effective in controlling the controlled device.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A wireless remote controller for a personal watercraft, the remote controller comprising:

a watertight housing forming a watertight compartment, the housing including a through hole extending through the housing from an upper side of the housing to a lower side of the housing;

a throttle interface removably attached to the housing such that the throttle interface is movable between a first position and a second position, at least a portion of the throttle interface positioned within the through hole of the housing; and a sensor positioned within the watertight compartment of the housing to detect a position of the throttle interface.

2. The wireless remote controller of claim 1 wherein the throttle interface includes a trigger, the trigger extending from the lower side of the housing.

3. The wireless remote controller of claim 1 wherein the throttle interface includes a thumbwheel having a protrusion, the protrusion extending from the upper side of the housing.

4. The wireless remote controller of claim 1 wherein the throttle interface includes a thumbwheel having a protrusion and a trigger, the protrusion extending from the upper side of the housing and the trigger extending from the lower side of the housing.

5. The wireless remote controller of claim 1 further comprising a cartridge configured to receive one of a plurality of throttle interface types, the throttle interface removably connected to the cartridge, the cartridge removably inserted into the through hole of the housing to removable attach the throttle interface to the housing.

6. The wireless remote controller of claim 5 wherein the throttle interface includes one or more magnets, wherein insertion of the cartridge into the through hole positions the one or more magnets of the throttle interface in proximity to the sensor.

7. The wireless remote controller of claim 5 where the housing includes a ledge extending into the through hole, a portion of the cartridge contacting the ledge.

8. The wireless remote controller of claim 7 wherein a fastener extends through the cartridge and into the ledge to secure the cartridge to the housing.

9. The wireless remote controller of claim 1 wherein the housing includes a gripping portion and a display portion, the through hole adjacent the gripping portion such that a user is able to manipulate the throttle interface on at least one of the upper and lower side of the housing while holding the gripping portion.

10. A remote controller comprising:

a housing;

a throttle interface including an outer body having a protrusion and a trigger lever extending therefrom, the throttle interface connected to the housing such that the throttle interface is movable between a first position and a second position; and a sensor connected to the housing and configured to detect a position of the outer body of the throttle interface.

11. The remote controller of claim 10 wherein the protrusion extends from a first side of the outer body and the trigger lever extends from a second side of the outer body.

12. The remote controller of claim 10 further comprising:

a watertight compartment within the housing;

wherein the throttle interface is disposed outside of the watertight compartment; and wherein the sensor is disposed inside of the watertight compartment.

13. The remote controller of claim 10 wherein the housing includes a gripping portion, the throttle interface mounted adjacent the gripping portion such that a user is able to engage at least one of the protrusion and trigger lever while holding the gripping portion.

14. The remote controller of claim 10 wherein the trigger lever extends from the outer body in a direction substantially opposite that which the protrusion extends from the outer body.

15. The remote controller of claim 10 wherein the throttle interface includes one or more magnets, the sensor configured to detect the position of the body based at least in part on the one or more magnets.

16. The remote controller of claim 10 wherein the housing includes a through hole extending through the housing from a first side of the housing to a second side of the housing, at least a portion of the throttle interface positioned within the through hole of the housing.

17. The remote controller of claim 10 wherein the housing forms a watertight compartment, the sensor disposed within the compartment of the housing.

18. The remote controller of claim 10 wherein the throttle interface includes a biasing mechanism biasing the outer body toward the first position.

19. A remote controller comprising:

a housing forming a watertight compartment;

a throttle interface connected to the housing and disposed outside of the watertight compartment, the throttle interface movable between a first position and a second position to provide input to control the throttle of a motorized vehicle; and a throttle lock connected to the housing and disposed outside of the watertight compartment, the throttle lock movable between an unlocked position and a locked position, wherein when the throttle lock is in the unlocked position the throttle interface is usable to control the throttle of the motorized vehicle and wherein when the throttle lock is in the locked position the throttle interface is not usable to control the throttle of the motorized vehicle.

20. The remote controller of claim 19 wherein the throttle lock extends from a lower side of the housing and the throttle interface includes a protrusion extending from an upper side of the housing.

21. The remote controller of claim 19 wherein the throttle lock includes a lever body pivotably connected to the housing.

22. The remote controller of claim 19 further comprising a processor and one or more sensors disposed in the watertight compartment of the watertight housing, the one or more sensors in communication with the processor and configured to detect the position of the throttle interface and the throttle lock, the processor configured to output throttle control commands effective to control the throttle of the motorized vehicle when the throttle lock is detected to be in the unlocked position.

23. The remote controller of claim 22 wherein the processor is configured to inhibit outputting throttle control commands when the throttle lock is detected to be in the locked position.

24. The remote controller of claim 22 wherein the throttle lock includes one or more magnets and the one or more sensors are configured to detect the position of the throttle lock based at least in part on the one or more magnets.

25. The remote controller of claim 19 wherein the throttle lock inhibits the throttle interface from moving from the first position toward the second position when the throttle lock is in the locked position.

26. The remote controller of claim 19 further comprising a cartridge receiving the throttle interface, the throttle lock mounted to the cartridge, the cartridge removably inserted into an opening of the housing to attach the throttle interface and throttle lock to the housing.

* * * * *